US008146909B2

(12) United States Patent
Kuno

(10) Patent No.: US 8,146,909 B2
(45) Date of Patent: Apr. 3, 2012

(54) SHEET ALIGNING DEVICE, SHEET PROCESSING DEVICE, AND IMAGE FORMING APPARATUS

(75) Inventor: Hiroyuki Kuno, Aichi (JP)

(73) Assignee: Ricoh Company, Limited, Tokyo (JP)

( * ) Notice: Subject to any disclaimer, the term of this patent is extended or adjusted under 35 U.S.C. 154(b) by 124 days.

(21) Appl. No.: 12/379,224

(22) Filed: Feb. 17, 2009

(65) Prior Publication Data

US 2009/0230613 A1 Sep. 17, 2009

(30) Foreign Application Priority Data

Mar. 17, 2008 (JP) ..... 2008-068421
Oct. 29, 2008 (JP) ..... 2008-278218

(51) Int. Cl.
*B65H 83/00* (2006.01)
*B65H 9/00* (2006.01)

(52) U.S. Cl. ..... 271/3.02; 271/236; 270/58.27

(58) Field of Classification Search ..... 271/176, 271/221, 220, 242, 234, 236, 3.01–3.03; 270/58.12, 58.17, 58.27
See application file for complete search history.

(56) References Cited

U.S. PATENT DOCUMENTS 6,120,020 A * 9/2000 Asao ..... 271/189
6,412,774 B1 * 7/2002 Saito et al. ..... 271/220
6,619,648 B2 * 9/2003 Sasamoto et al. ..... 271/3.03
6,634,641 B2 * 10/2003 Yamakawa et al. ..... 271/220
6,905,118 B2 6/2005 Yamada et al.
7,137,625 B2 11/2006 Yamada et al.
7,192,020 B2 * 3/2007 Hayashi et al. ..... 270/58.11
7,407,155 B2 8/2008 Tamura et al.
7,416,177 B2 8/2008 Suzuki et al.
7,744,085 B2 * 6/2010 Tsutsui et al. ..... 271/221
2006/0180999 A1 8/2006 Suzuki et al.
2007/0035079 A1 2/2007 Yamada et al.
2007/0035080 A1 * 2/2007 Yamada et al. ..... 270/58.07
2007/0056423 A1 3/2007 Yamada et al.
2008/0179809 A1 7/2008 Kikkawa et al.
2009/0014939 A1 * 1/2009 Ichihashi et al. ..... 271/3.02

FOREIGN PATENT DOCUMENTS

JP 2005-132616 5/2005

* cited by examiner

*Primary Examiner* — Kaitlin S Joerger
*Assistant Examiner* — Patrick Cicchino
(74) *Attorney, Agent, or Firm* — Harness, Dickey & Pierce, P.L.C.

(57) ABSTRACT

A conveying unit receives a sheet from an upstream unit and conveys the sheet on a conveying path. A stacking unit stacks the sheet conveyed from the conveying unit. An aligning unit sets the sheet back in a direction opposite to a sheet conveying direction and aligns the sheet by bumping the sheet against a reference wall. A sheet discharging unit discharges the sheet aligned on the stacking unit. When a predetermined condition is satisfied, a control unit sets a timing for discharging the sheet by the sheet discharging unit earlier than a normal sheet discharge timing.

17 Claims, 23 Drawing Sheets

FIG. 13A RECEIVE SHEET
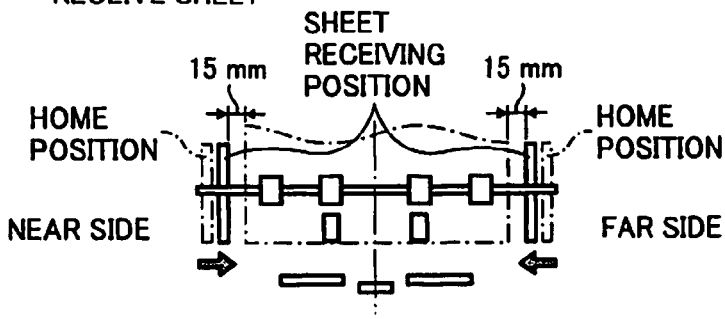
FIG. 13B SHEET DISCHARGE
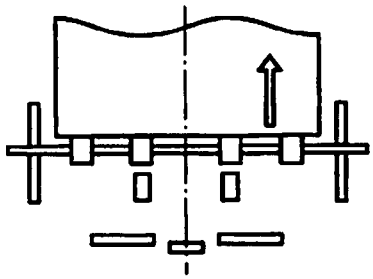
FIG. 13C PUSH BACK COMPLETION
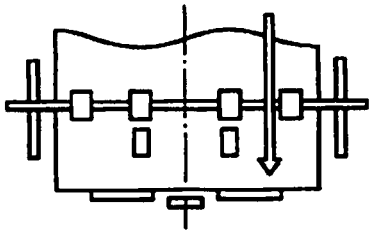
FIG. 13D NEAR SIDE ALIGNMENT
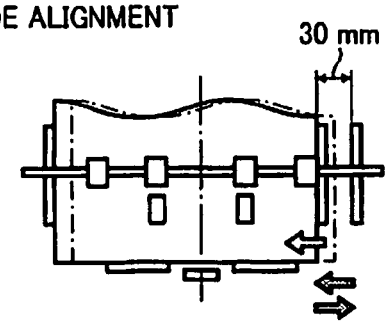
FIG. 13E DISCHARGE
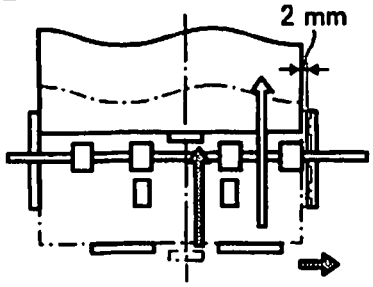

FIG. 13F RECEIVE NEXT SHEET
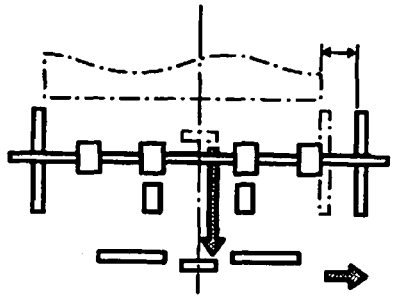
FIG. 13G FAR SIDE ALIGNMENT
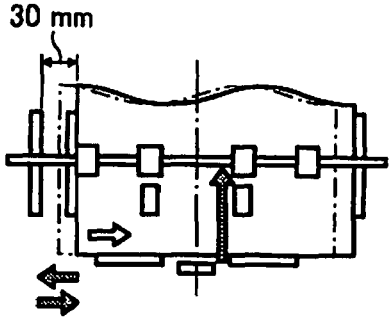
FIG. 13H DISCHARGE
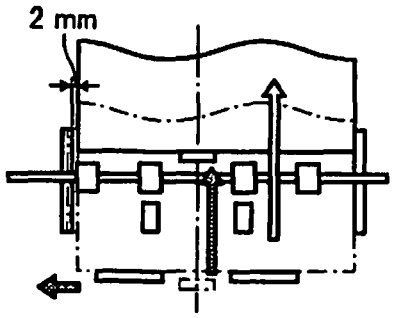
FIG. 13I HOME
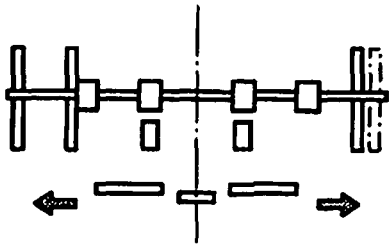

FIG. 14A COMMENCEMENT OF DISCHARGE
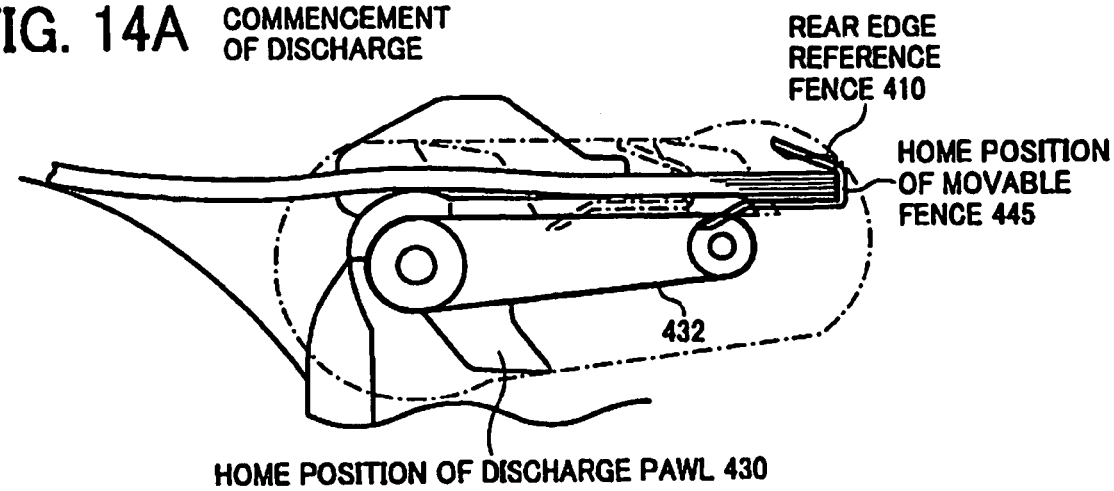
FIG. 14B MOVABLE FENCE PRESSES DOWN⇒ DISCHARGE PAWL PASSES OVER
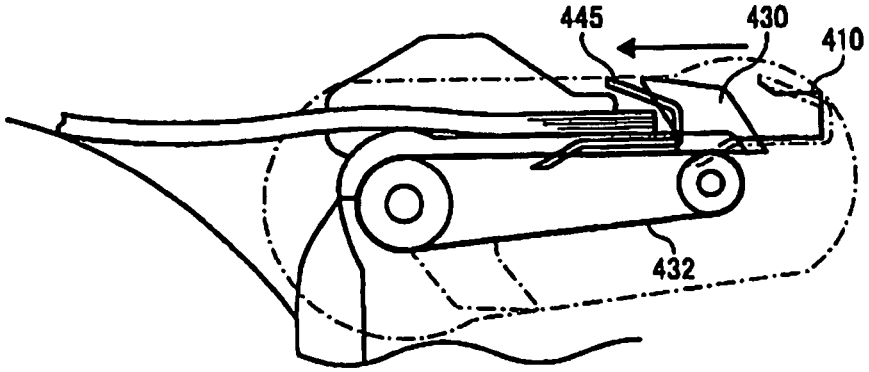
FIG. 14C HALTS FOR A WHILE (COMPLETION OF FIRST STAGE OF SHIFT)
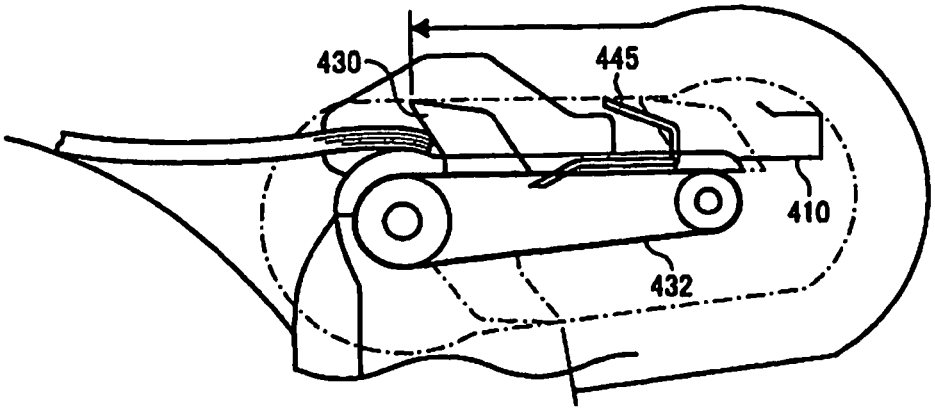

FIG. 14D DISCHARGE TRAY LOWERS (COMPLETION OF SECOND STAGE OF SHIFT)
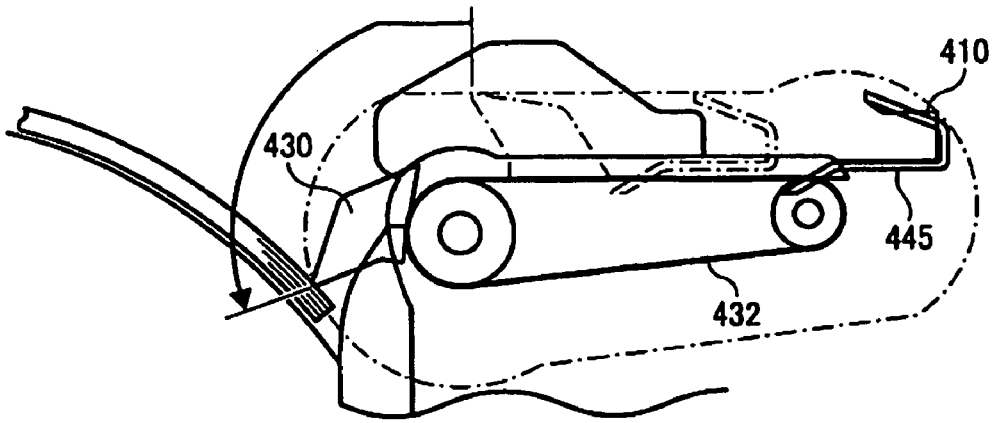
FIG. 14E RETURNS TO HOME POSITION
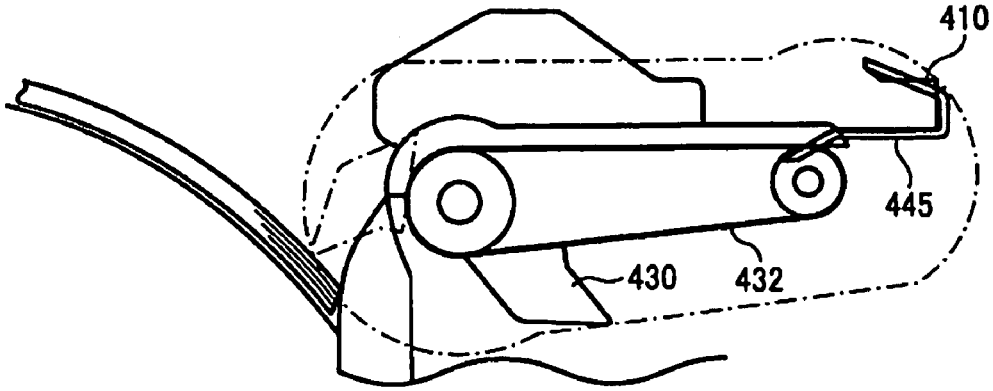

SHEET ALIGNING DEVICE, SHEET PROCESSING DEVICE, AND IMAGE FORMING APPARATUS

CROSS-REFERENCE TO RELATED APPLICATIONS

The present application claims priority to and incorporates by reference the entire contents of Japanese priority document 2008-068421 filed in Japan on Mar. 17, 2008 and Japanese priority document 2008-278218 filed in Japan on Oct. 29, 2008.

BACKGROUND OF THE INVENTION

1. Field of the Invention

The present invention relates to a sheet aligning device that performs a sheet-aligning function, a sheet processing device that includes the sheet aligning device, and an image forming apparatus, such as a copier, printer, facsimile, or a digital multifunction peripheral (MFP) that performs copying, printing, and facsimile functions, that includes the sheet processing device.

2. Description of the Related Art

The prevalence of sheet processing devices equipped with functions such as sheet aligning, finishing, and folding processing has increased in recent years parallel with the prevalence of image forming apparatuses. For example, Japanese Patent Application Laid-open No. 2005-132616 discloses a sheet post-processing device that receives sheets discharged from an image forming apparatus one by one and performs a sheet post-process on each sheet, and that includes a processing tray that includes an aligning unit that aligns sheets, a stapling unit that staples a sheet bunch, and a sheet ejecting unit that ejects the stapled sheet bunch in a sheet discharge direction, a first conveying path, which is the main conveying path, that includes a detecting unit that detects the sheet, and a conveying unit that conveys the sheet in a downstream direction or in a reverse direction, a second conveying path that receives the sheet conveyed in the reverse direction and conveys the sheet to a designated position and is capable of retaining a plurality of such sheets, a switching unit that switches the conveying path of the sheet from the first conveying path to the second conveying path, and a catch tray that receives the sheet discharged by a sheet discharging unit. In the sheet post-processing device, a plurality of sheets belonging to one sheet bunch is conveyed for sheet post-processing in such a way that the sheet conveyed by the second conveying path is stacked with the sheet conveyed by the first conveying path when being discharged to the processing tray. In a mixed loading mode for sheets of varying sizes form a single sheet bunch, a preceding sheet is retained if it is of retainable size. In this disclosed invention, the second conveying path is employed to secure a processing time/expelling time for the sheet or the sheet bunch.

However, generally, in an image-forming apparatus equipped with a sheet post-processing device, when the sheet already received is being subjected to post-processing such as aligning and stapling, the processing tray is unable to receive the succeeding sheet, necessitating increased gap between the sheets and resulting in a drop in productivity.

Mechanisms, such as that mentioned in the above invention, for temporarily retaining the sheets prior to being discharged into the processing tray, have been proposed to address the problem. Such a mechanism retains and stacks a first few sheets of the next sheet bunch before discharging them to the processing tray, thus avoiding discharge of single sheets when the previous sheet bunch is being processed, and a drop in productivity. However, such a mechanism is often complicated and tends to increase the bulk as well as the cost of the image forming apparatus. Further, this processing method is ineffective in preventing a drop in productivity if there is only a single sheet in each lot.

SUMMARY OF THE INVENTION

It is an object of the present invention to at least partially solve the problems in the conventional technology.

According to one aspect of the present invention, there is provided a sheet aligning device including a conveying unit that receives a sheet from an upstream unit and conveys the sheet on a conveying path; a stacking unit that stacks the sheet conveyed from the conveying unit; a first aligning unit that sets the sheet back in a direction opposite to a sheet conveying direction and aligns the sheet by bumping the sheet against a reference wall; a sheet discharging unit that discharges the sheet aligned on the stacking unit; and a control unit that, when a predetermined condition is satisfied, sets a timing for discharging the sheet by the sheet discharging unit earlier than a normal sheet discharge timing.

Furthermore, according to another aspect of the present invention, there is provided a sheeting processing device including a sheet aligning device. The sheet aligning device includes a conveying unit that receives a sheet from an upstream unit and conveys the sheet on a conveying path, a stacking unit that stacks the sheet conveyed from the conveying unit, a first aligning unit that sets the sheet back in a direction opposite to a sheet conveying direction and aligns the sheet by bumping the sheet against a reference wall, a sheet discharging unit that discharges the sheet aligned on the stacking unit, and a control unit that, when a predetermined condition is satisfied, sets a timing for discharging the sheet by the sheet discharging unit earlier than a normal sheet discharge timing.

Moreover, according to still another aspect of the present invention, there is provided an image forming apparatus including a sheeting processing device that includes a sheet aligning unit. The sheet aligning unit includes a conveying unit that receives a sheet from an upstream unit and conveys the sheet on a conveying path, a stacking unit that stacks the sheet conveyed from the conveying unit, a first aligning unit that sets the sheet back in a direction opposite to a sheet conveying direction and aligns the sheet by bumping the sheet against a reference wall, a sheet discharging unit that discharges the sheet aligned on the stacking unit, and a control unit that, when a predetermined condition is satisfied, sets a timing for discharging the sheet by the sheet discharging unit earlier than a normal sheet discharge timing.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIGS. 13A to 13I are schematic diagrams for explaining a sheet aligning operation of jogger fences in a sift mode;

FIGS. 14A to 14E are schematic diagrams for explaining a sheet discharge operation by a movable fence and discharge pawls;

DETAILED DESCRIPTION OF THE PREFERRED EMBODIMENTS

Exemplary embodiments of the present invention are explained below with reference to the accompanying drawings.

Figure 1:
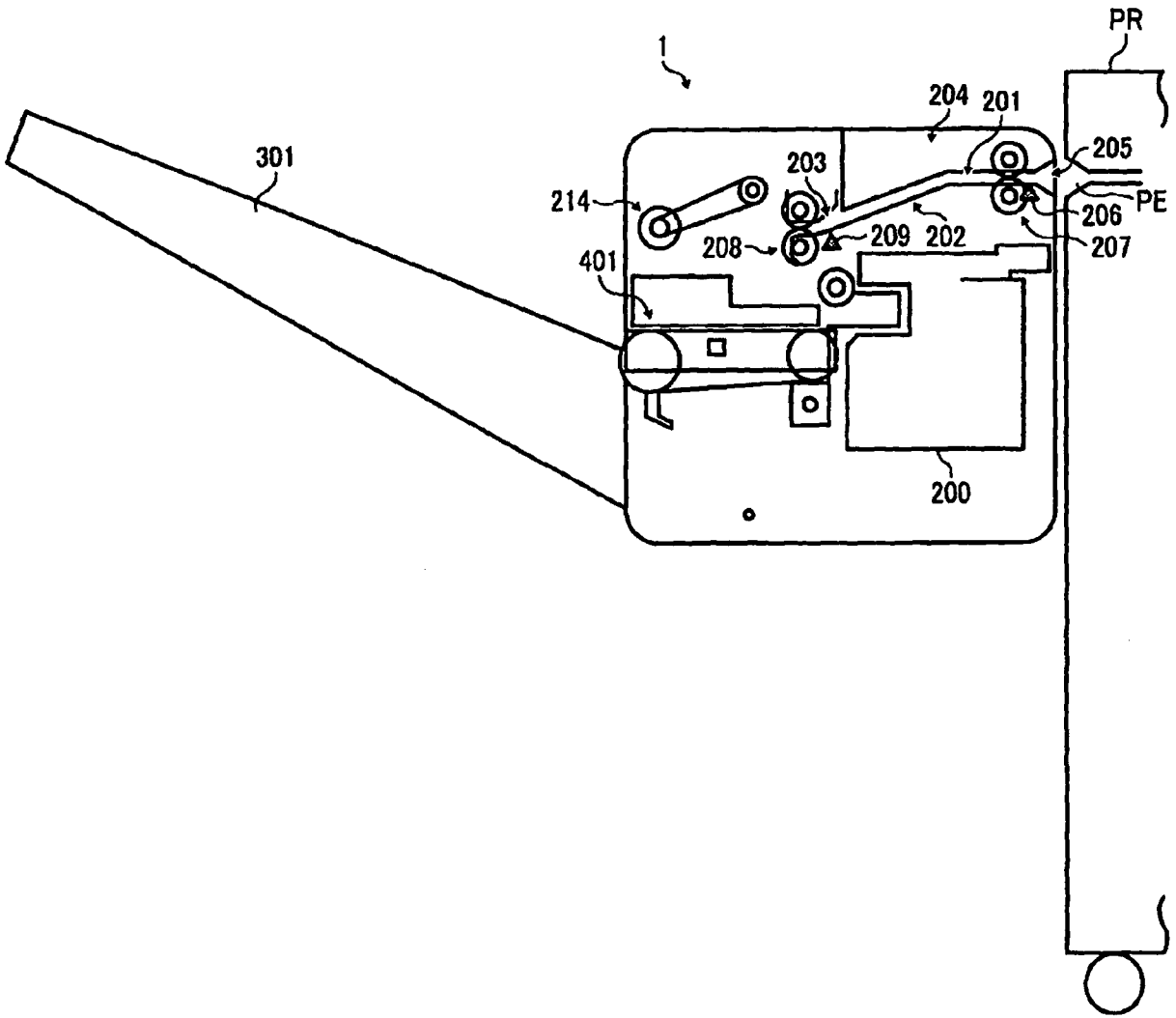
FIG. 1 is a schematic diagram of a sheet post-processing device that functions as a sheet processing device according to an embodiment of the present invention, along with a portion of an image forming apparatus.

FIG. 1 is a schematic diagram of a sheet post-processing device 1 that functions as a sheet processing device according to an embodiment of the present invention, along with a portion of an image forming apparatus PR. A sheet inlet 205 of the sheet post-processing device 1 is connected to a sheet exit PE of the image forming apparatus PR to enable the sheet post-processing device 1 to receive sheets for post-processing.

The sheet post-processing device 1 includes a stapler 200, a conveying path 204, a stapling tray 401, a tapping roller 214, and a catch tray 301. The conveying path 204 is formed from a conveying guide plate 201, an opening-closing guide plate 202, and a sheet-discharge guide plate 203. The sheet inlet 205 is disposed at the extreme upstream end of the conveying path 204, and corresponds to the extreme upstream end of a sheet conveyance direction of the conveying guide plate 201 and the opening-closing guide plate 202. A sheet inlet sensor 206 that detects a position of the sheet is provided near the sheet inlet 205 downstream thereof. A conveying roller pair 207 is provided near the sheet inlet sensor 206 downstream thereof. A pair of discharge rollers 208 is provided at the extreme downstream end of the sheet conveyance direction. A discharge sensor 209 is provided near the discharge rollers 208 upstream thereof.

Figure 2:
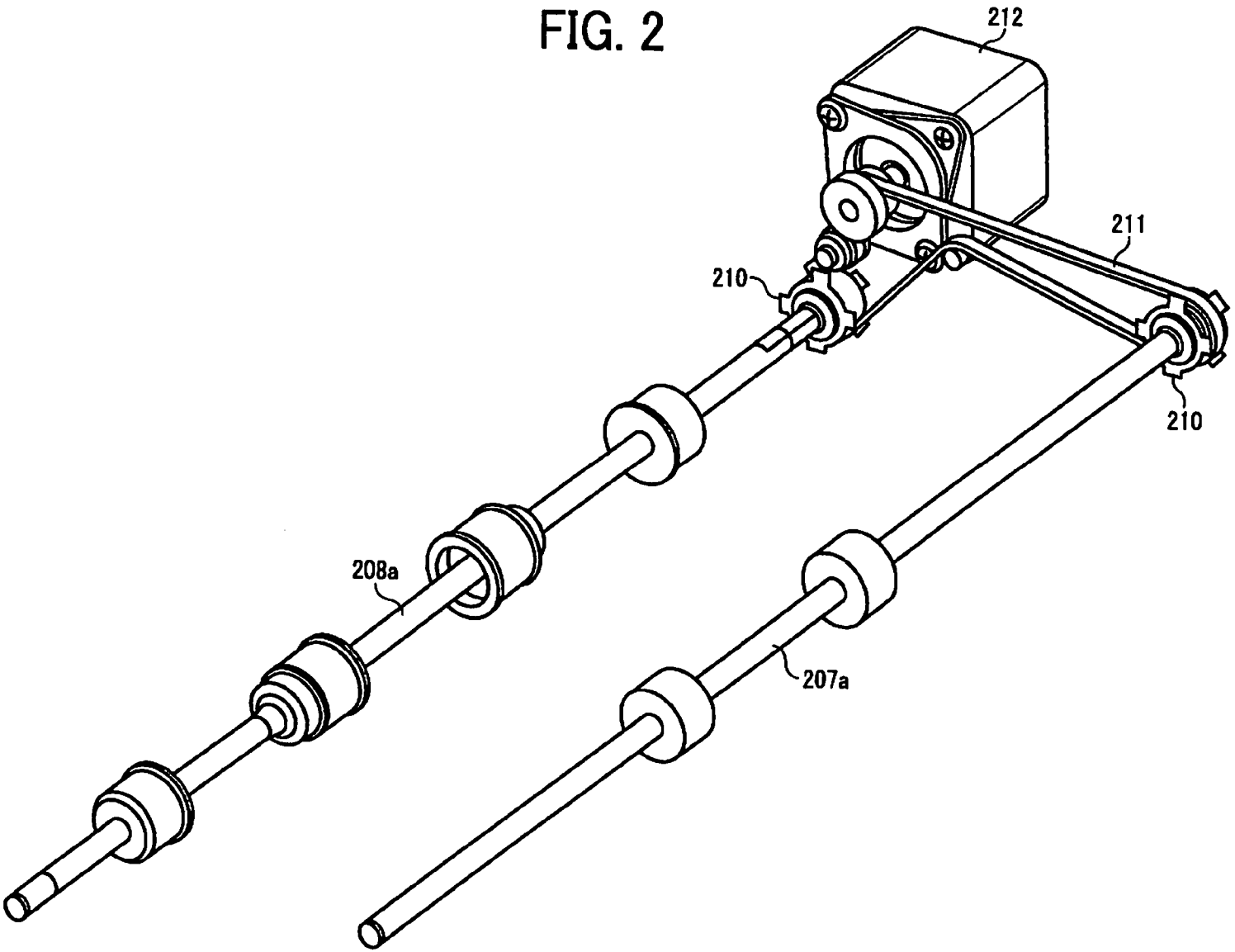
FIG. 2 is an oblique view of a driving mechanism of a conveying roller pair and a pair of discharge rollers shown in FIG. 1.

FIG. 2 is an oblique view of a driving mechanism of the conveying roller pair 207 and the discharge rollers 208. A driving-end conveying roller 207*a* and a driving-end discharge roller 208*a* of the conveying roller pair 207 and the discharge rollers 208, respectively, are coupled to a stepping motor 212 via a pulley 210 and a timing belt 211. The conveying roller pair 207 and the discharge rollers 208 are driven to rotate by the rotary driving force of the stepping motor 212.

Figure 3A:
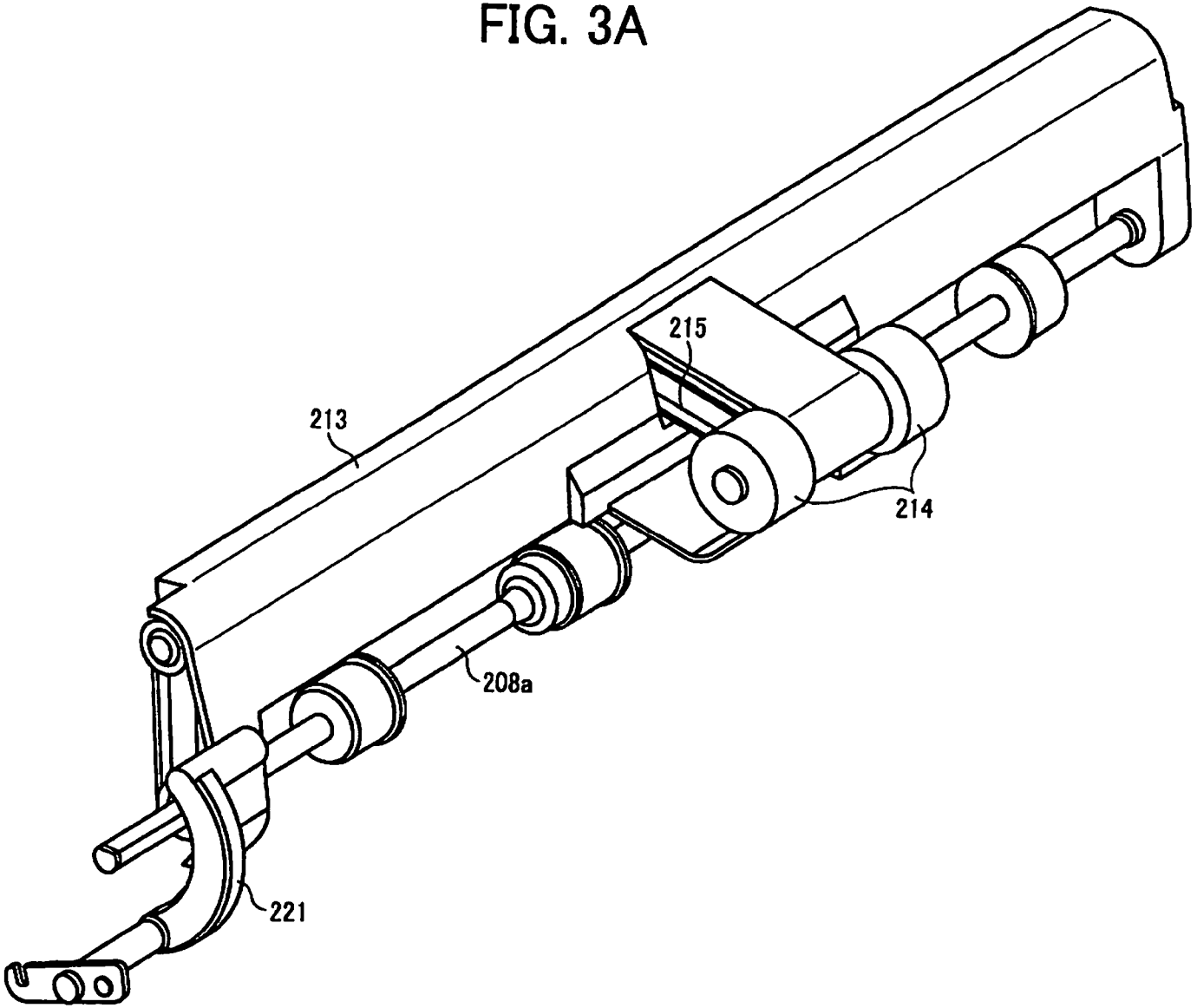
FIGS. 3A and 3B are oblique views of the discharge rollers and a tapping roller shown in FIG. 1.
Figure 3B:
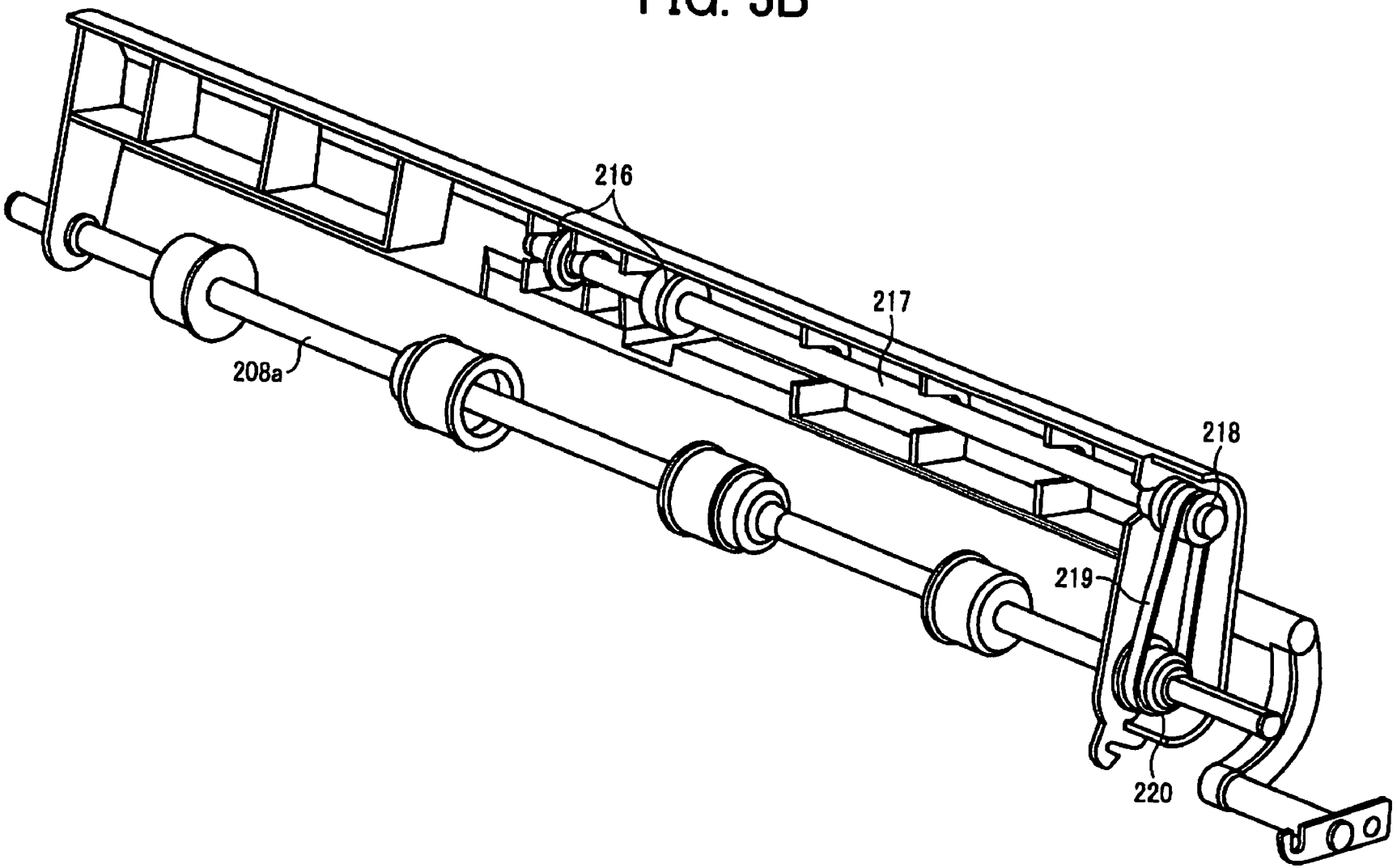

FIGS. 3A and 3B are oblique views of the discharge rollers 208 and the tapping roller 214. FIG. 3A is a view from the side the tapping roller 214 is installed. FIG. 3B is a rear view of FIG. 3A. A swinging arm 213 is slidably provided coaxially with the driving-end discharge roller 208*a*. The tapping roller 214, made from an elastic frictional sponge, is provided on the swinging arm 213. The tapping roller 214 is mounted at the fore-end of the swinging arm 213 that extends from its free-end towards the downstream side of a sheet discharge direction.

The tapping roller 214 is coupled to a pulley 220 fixed to a shaft of the driving-end discharge roller 208*a* via a timing belt 215, a first pulley 216, a shaft 217, a second pulley 218, and a second timing belt 219, and is configured to rotate in one direction by the rotation of the driving-end discharge roller 208*a*. The first pulley 216 is fixed to an end of the shaft 217 that is substantially aligned with the mid portion of the swinging arm 213, and the second pulley 218 is fixed to another end of the shaft 217 that is aligned with the end of the swinging arm 213. The first pulley 216 and the second pulley 218 rotate in unison. The swinging arm 213 is configured to be always loaded towards the stapling tray 401 due to the weight of the swinging arm 213 or a spring (not shown). A lever 221 that is loaded in the direction away from the stapling tray 401 holds the swinging arm 213 impinging against a stopper 222. With the to and fro motion of the lever 221, the swinging arm 213 turns towards the stapling tray 401, causing the tapping roller 214 to come in contact with the stapling tray 401, and turns further and comes to a halt when it comes in contact with the stopper 222.

Figure 4:
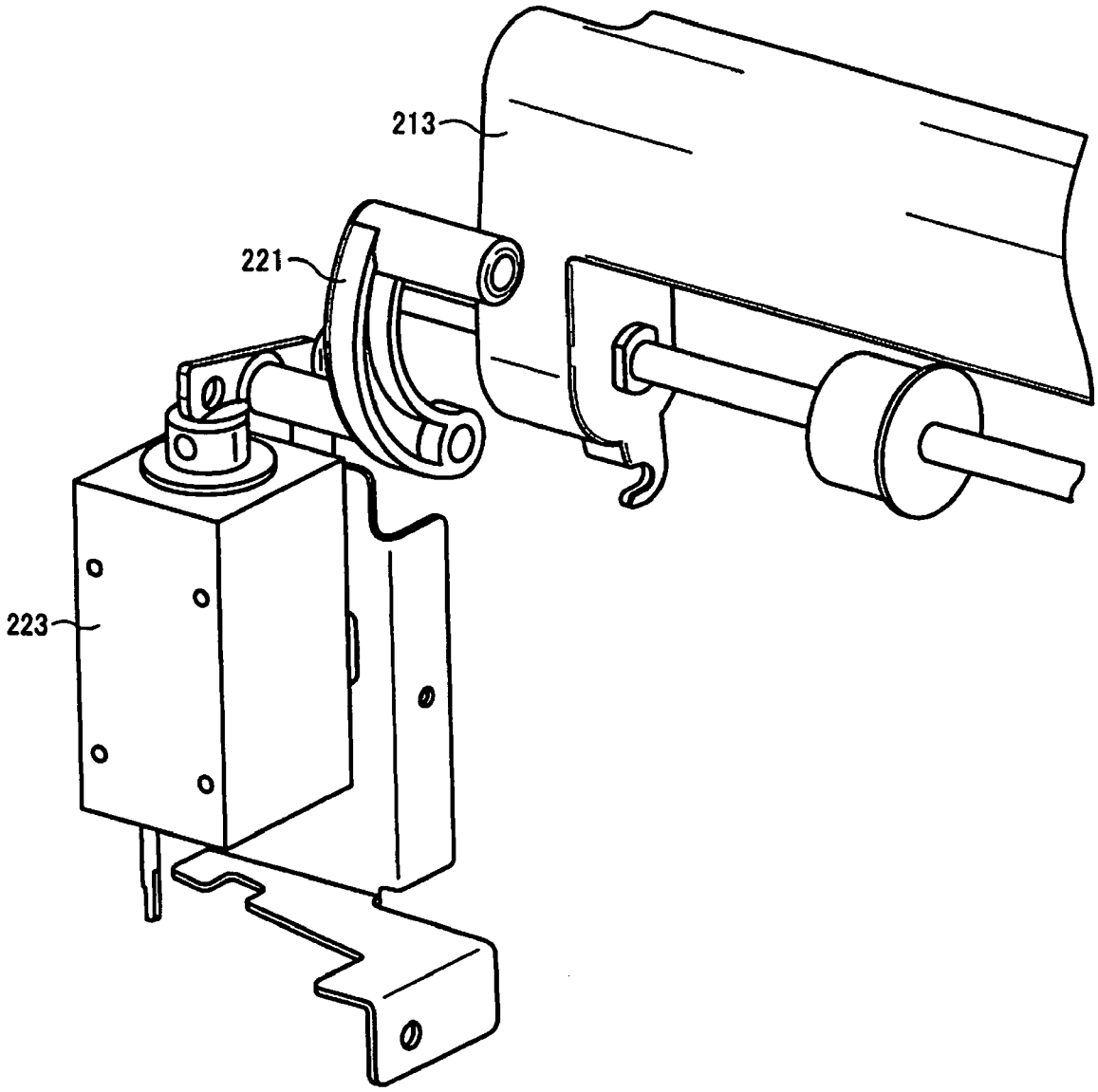
FIG. 4 is an oblique view of a direct-current/solenoid (DC/SOL) motor used as a driving mechanism of a lever.
Figure 5:
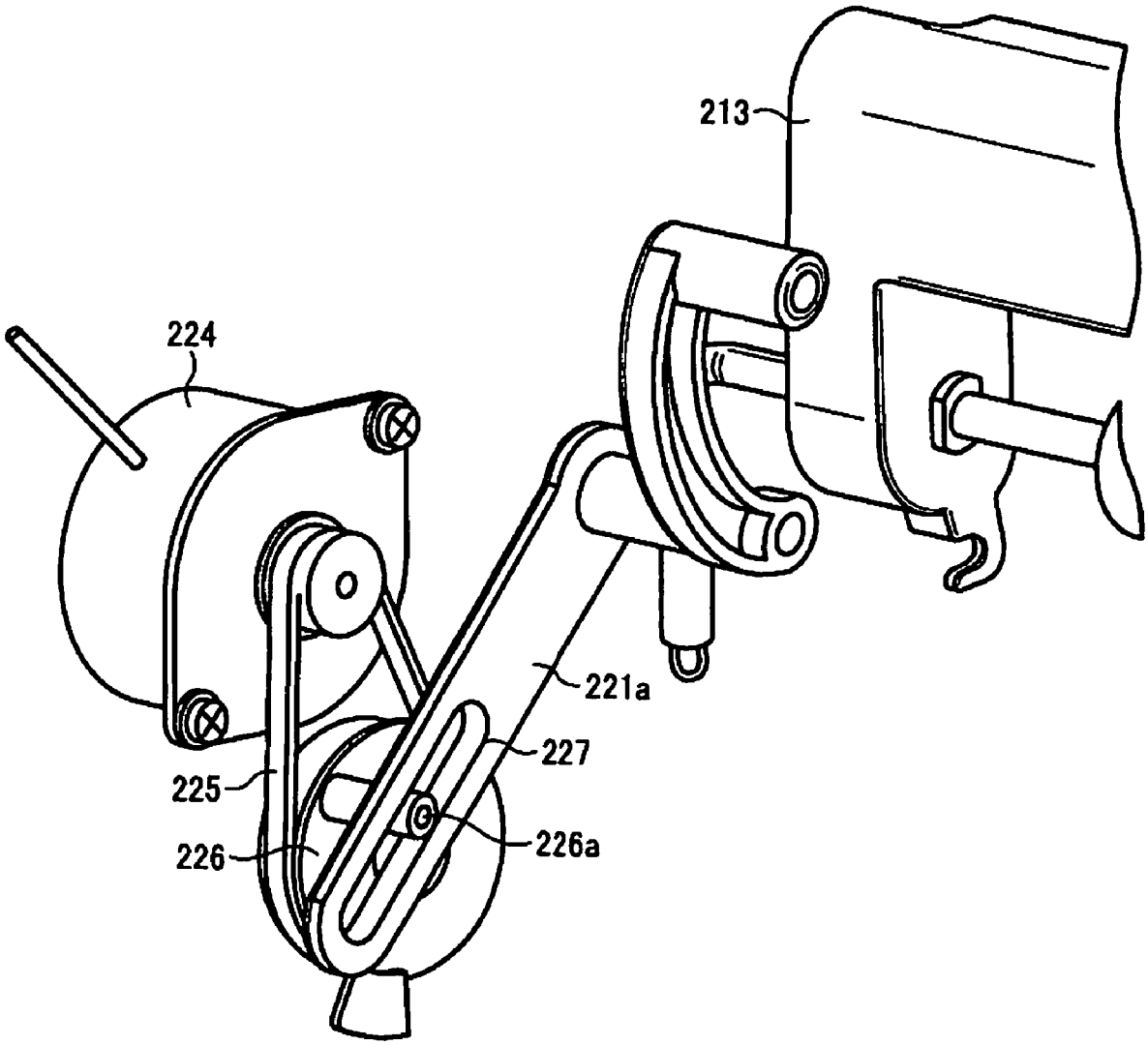
FIG. 5 is an oblique view of a stepping motor used as the driving mechanism of the lever.

FIGS. 4 and 5 are oblique views of driving mechanisms of the lever 221. In FIG. 4, the driving mechanism used for the lever 221 is a direct-current/solenoid (DC/SOL) motor, whereas in FIG. 5, the driving mechanism is a stepping motor. In other words, in the example shown in FIG. 4, a DC/SOL 223 coupled to the lever 221 drives the lever 221 to slide. In the example shown in FIG. 5, the rotary motion of a stepping motor 224 drives a cam 226 coupled to the stepping motor 224 via a timing belt 225 to rotate, and a lever 221*a* is driven to rotate by the cam 226 due to a cam lug 226*a* being inserted into a linking unit 227 of the lever 221*a*.

Figure 6:
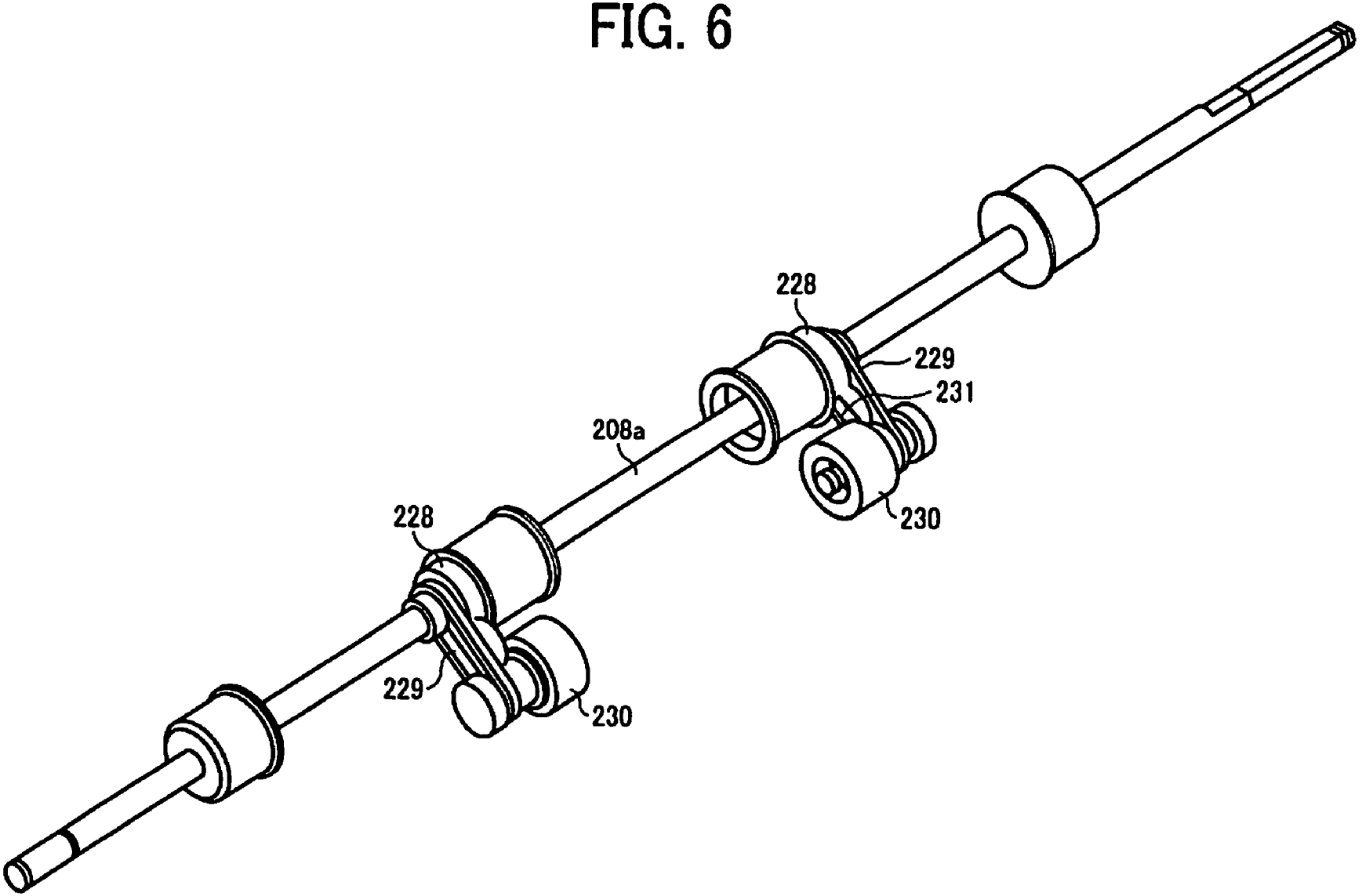
FIG. 6 is an oblique view of parts in the vicinity of a driving-end discharge roller.

FIG. 6 is an oblique view of parts in the vicinity of the driving-end discharge roller 208*a* of the discharge rollers 208. A gear 228 is fitted to the shaft of the driving-end discharge roller 208*a*. A holder 229 is also rotatably provided on the driving-end discharge roller 208*a*. A returning roller 230 made from an elastic frictional sponge is provided in the holder 229. The returning roller 230 is coupled to the gear 228 via an intermediate gear 231, and thereby the rotation of the driving-end discharge roller 208*a* is transmitted to the returning roller 230. The holder 229 is configured to be always loaded towards the stapling tray 401 due to the weight of the holder 229 and the weight of the returning roller 230. The returning roller 230 rotates with its outer periphery always in contact with the stapling tray 401.

Figure 7:
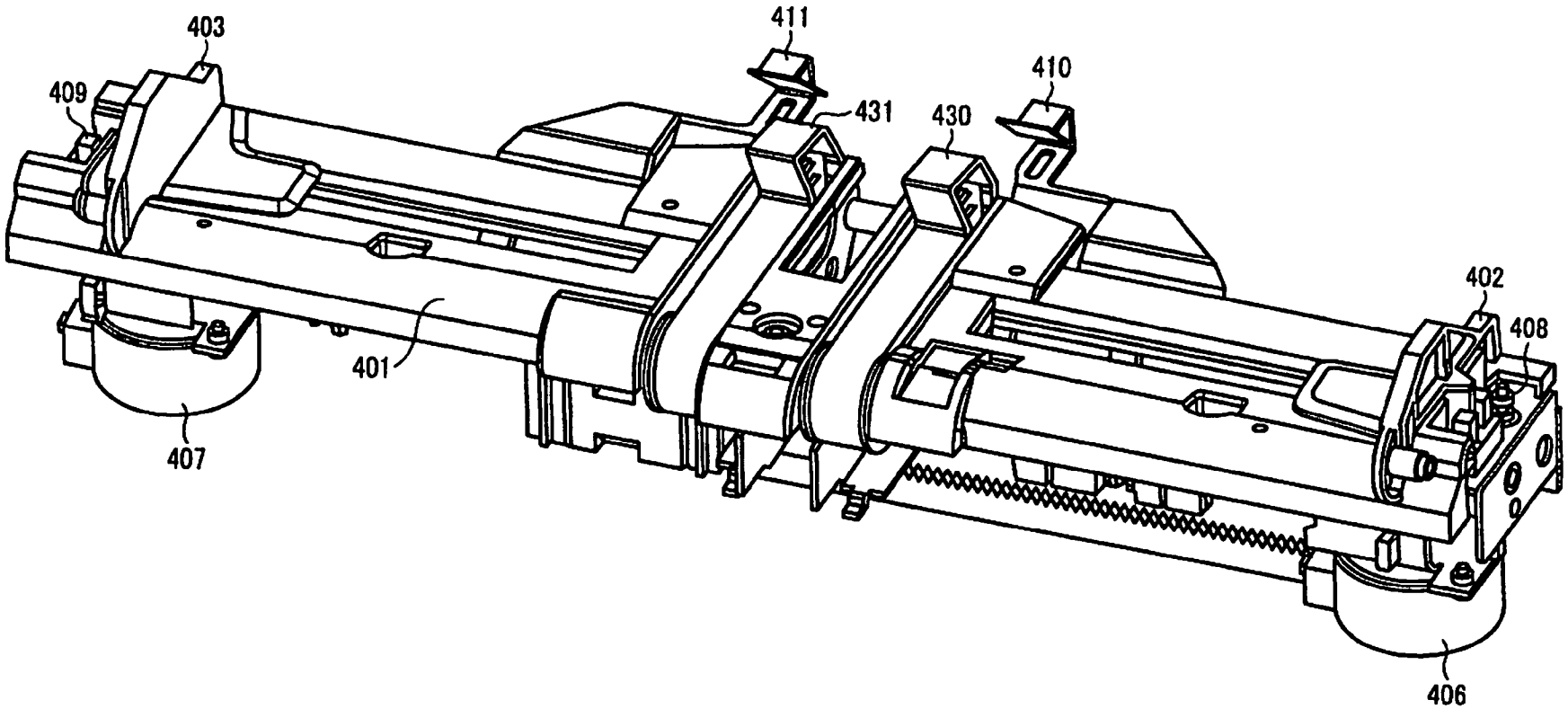
FIG. 7 is an oblique view of an aligning unit and a sheet discharging unit.
Figure 8:
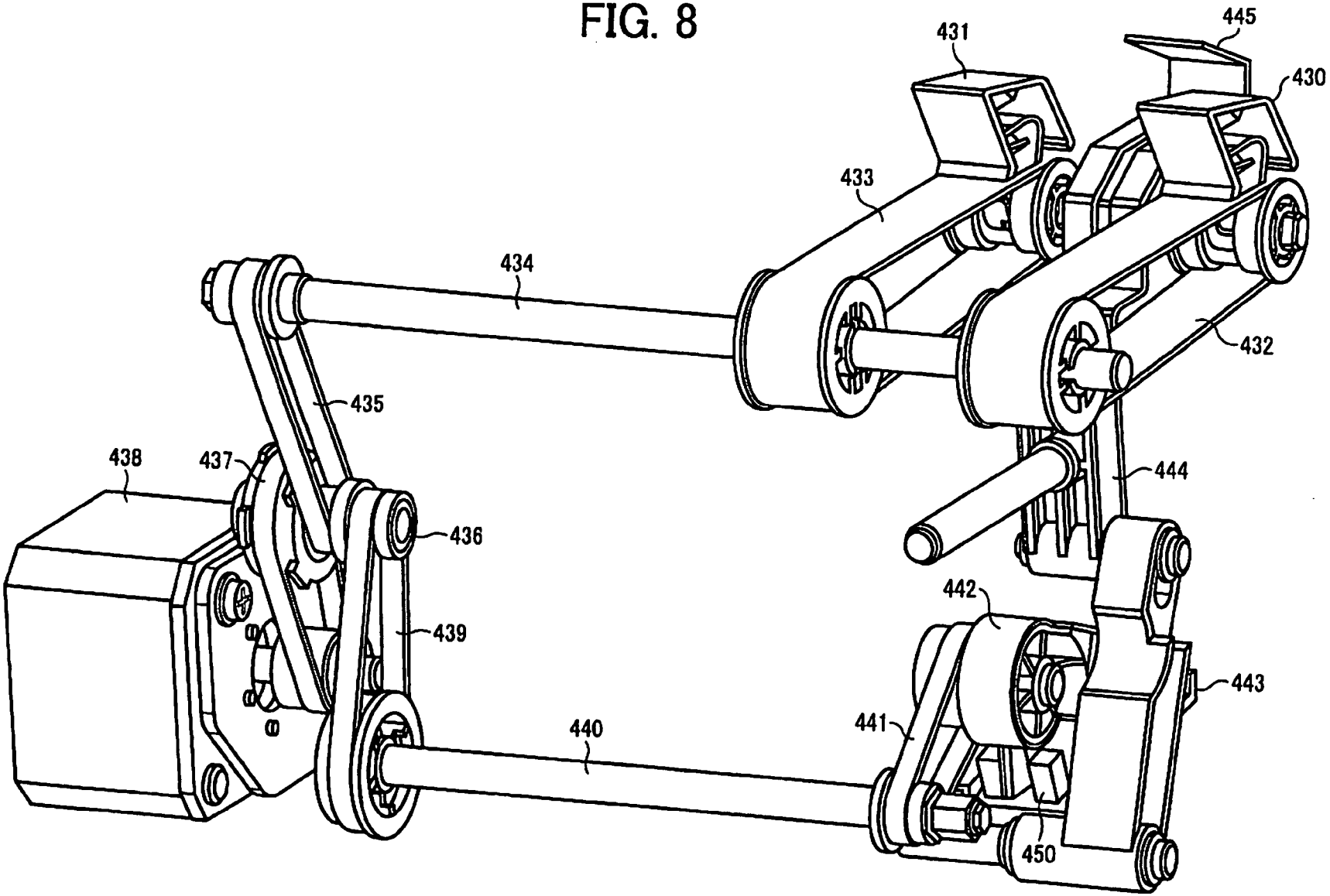
FIG. 8 is an oblique view of the aligning unit and the sheet discharging unit.

FIGS. 7 and 8 are oblique views of an aligning unit and a sheet discharging unit. As shown in FIGS. 7 and 8, jogger fences 402 and 403, of which the jogger fence 402 is a near-side jogger fence and the jogger fence 403 is a far-side jogger fence, are provided in the stapling tray 401. The jogger fences 402 and 403 are inserted into a guide shaft (not shown) fixed to the stapling tray 401, the two edges of the stapling tray 401 being their standby positions, and are configured to move towards the mid portion in the sheet conveyance direction. The jogger fences 402 and 403 are coupled to jogger-driving stepping motors 406 and 407, respectively, via timing belts (not shown). The jogger-driving stepping motors 406 and 407 move to and fro in a straight line due to clockwise and counter-clockwise rotary drive. Home sensors 408 and 409 are provided on the stapling tray 401 for detecting the standby positions of the jogger fences 402 and 403, respectively. A pair of reference fences 410 and 411 is provided on the stapling tray 401. The jogger fences 402 and 403 also perform sifting by altering the alignment position of each sheet bunch in a direction orthogonal to the sheet conveyance direction.

Discharge pawls 430 and 431 fixed to discharge belts 432 and 433 are provided on the stapling tray 401. The discharge belts 432 and 433 are coupled to a discharge stepping motor 438 via a pulley, a drive shaft 434, timing belts 435 and 437, and deceleration pulley 436. The discharge stepping motor 438 is coupled to a movable fence 445 via the deceleration pulley 436, timing belts 439 and 441, a drive shaft 440, a cam 442, an arm 443, and a slider 444. A spring (not shown) stretches the movable fence 445 on the side opposite to the catch tray 301. The movable fence 445 moves to and fro over the stapling tray 401 due to the unidirectional rotation of the discharge stepping motor 438, and coupled to the movement of the movable fence 445, the discharge pawls 430 and 431 rotate around the periphery of the stapling tray 401, discharging the sheet from the stapling tray 401 to the catch tray 301. A discharge home sensor 450 is provided in the sheet discharging unit for detecting standby positions of the movable fence 445 and the discharge pawls 430 and 431.

Figure 9:
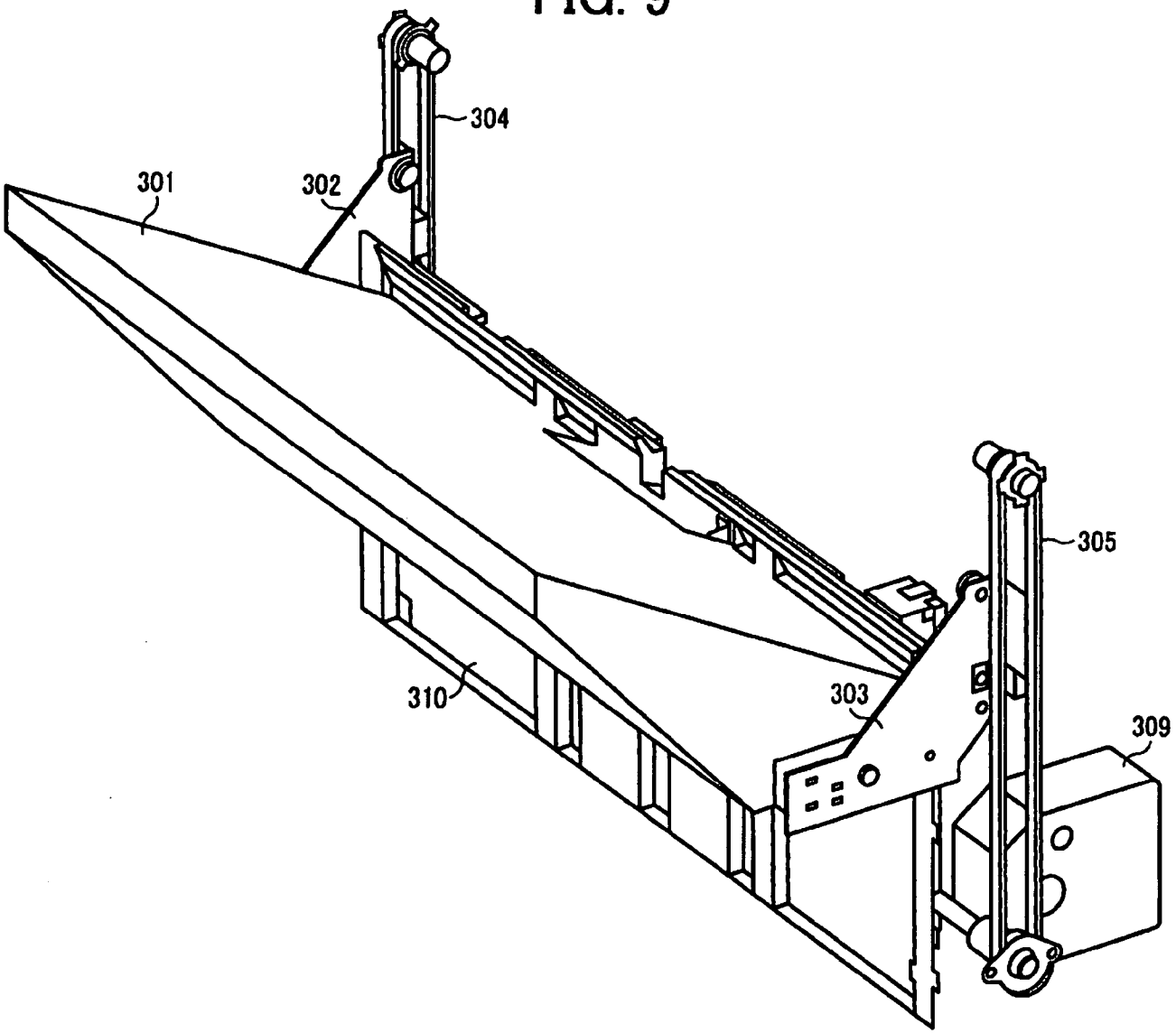
FIG. 9 is an oblique view of a catch tray seen from a downstream side of a sheet discharge direction.
Figure 10:
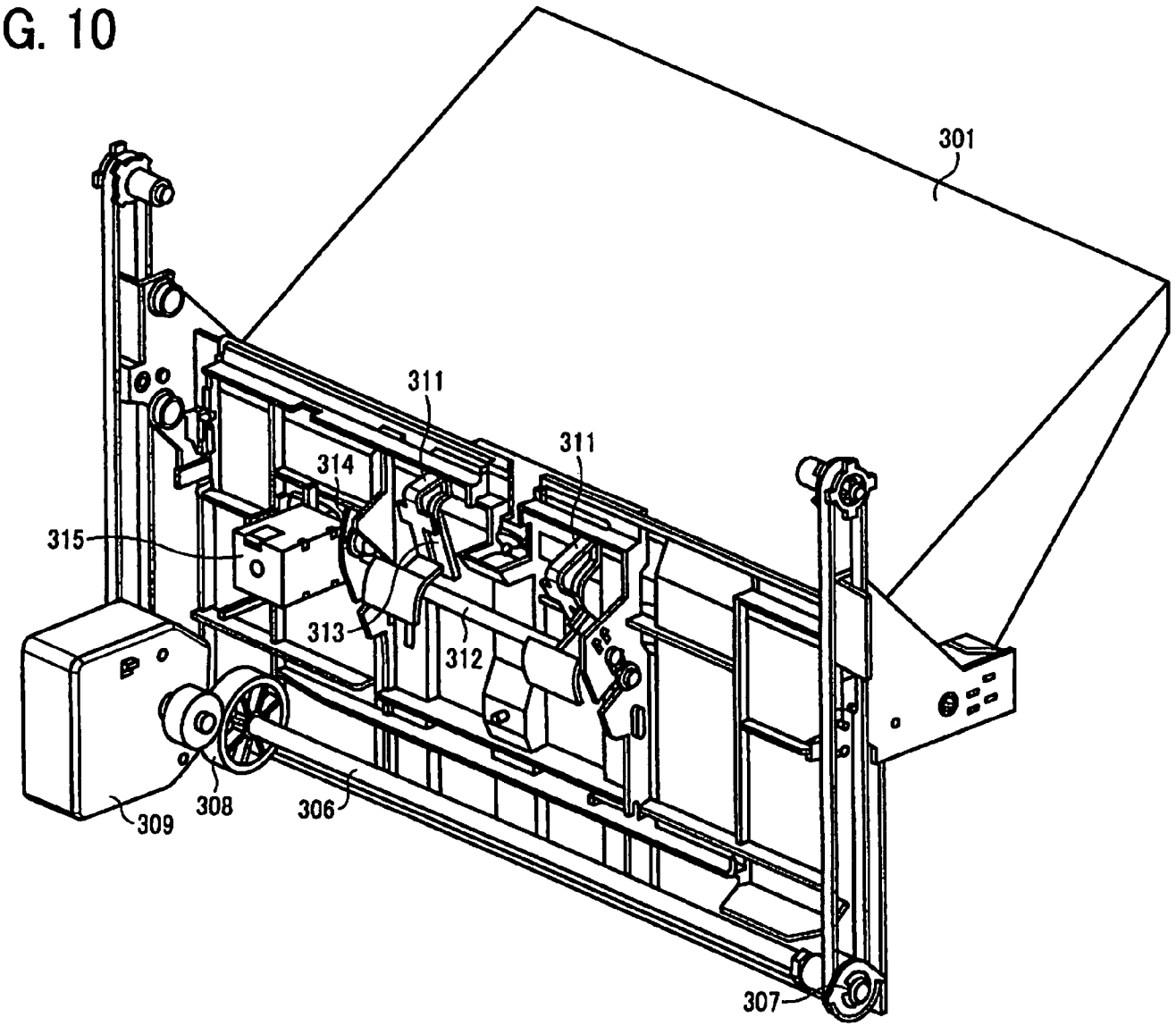
FIG. 10 is an oblique view of the catch tray seen from an upstream side of the sheet discharge direction.
Figure 11:
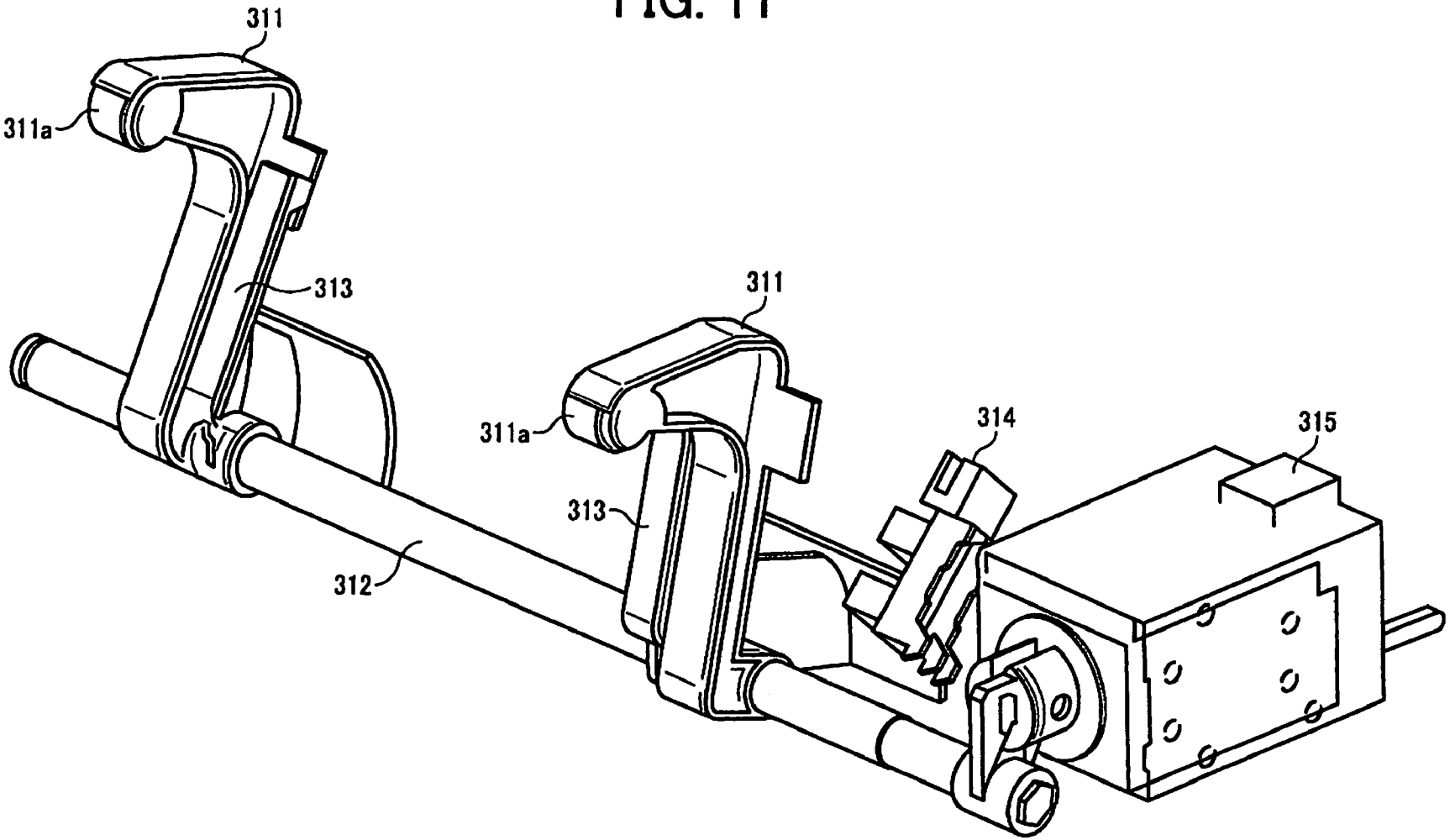
FIG. 11 is an oblique view of a driving mechanism of a sheet holding member.

FIG. 9 is an oblique view of the catch tray seen from a downstream side of the sheet discharge direction. FIG. 10 is an oblique view of the catch tray seen from an upstream side of the sheet discharge direction. FIG. 11 is an oblique view of a driving mechanism of a sheet holding member. In FIGS. 9 to 11, the catch tray 301 is fixed to supporting members 302 and 303. The supporting members 302 and 303 are coupled to a drive shaft 306 via timing belts 304 and 305, and a pulley 307. A gear 308 is fitted to the drive shaft 306. The drive shaft 306 is coupled to a DC motor 309 via the gear 308. The drive force of the DC motor 309 is transmitted to the gear 308, which then raises and lowers the catch tray 301.

An end fence 310 that is substantially vertical is provided in the catch tray 301, and a rotary shaft 312 fitted with a lever 313 as shown in FIG. 10 is mounted on the end fence 310. Two sheet holding members 311 are rotatably inserted near the two ends of the rotary shaft 312. A spring (not shown) that applies pressure in the direction of the end fence 310 is provided at the fore-end of each of the sheet holding members 311. A DC/SOL 315 is fixed near one end of the rotary shaft 312. The DC/SOL 315 causes the rotary shaft 312 to move to and fro at a constant angle. The movement of the rotary shaft 312 turns the lever 313, which in turn, turns the sheet holding members 311. A sheet-height detecting sensor 314 is provided on the end fence 310.

As shown in FIG. 11, the spring holds a fore-end 311*a* of the sheet holding member 311 at a position that juts out in relation to a sheet aligning face of the end fence 310. The suction action of the DC/SOL 315 causes the fore-end 311*a* to turn so as to be more completely retracted than the sheet aligning face of the end fence 310.

The sheet-height detecting sensor 314 detects the height of stacked sheets in the catch tray 301 by detecting a detecting unit provided in a portion of the sheet holding member when the topmost surface of the sheets stacked in the ascending catch tray 301 thrusts up against the fore-ends 311*a* of the sheet holding members 311.

Figure 12:
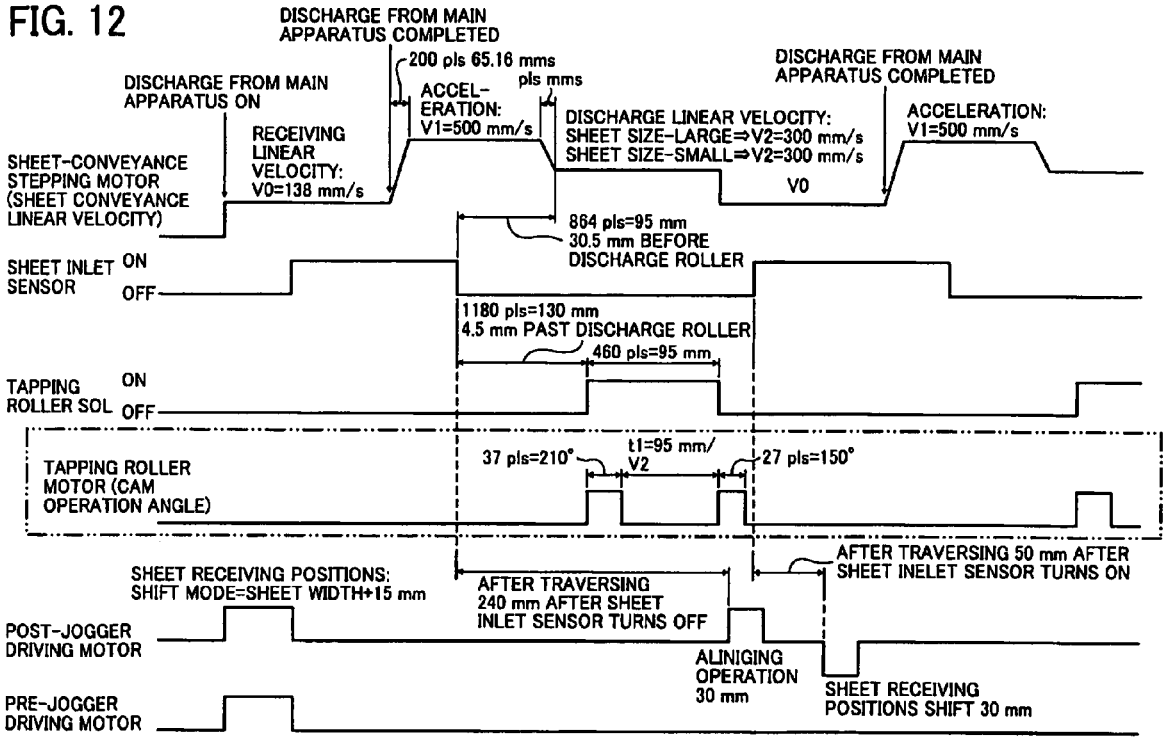
FIG. 12 is a timing chart of drive timings of a sheet-conveying stepping motor, a sheet inlet sensor, a tapping roller SOL, a tapping roller stepping motor, as well as a pre-jogger driving motor and a post-jogger driving motor.
Figure 15A:
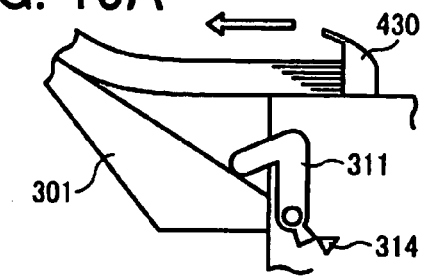
FIGS. 15A to 15H are schematic diagrams for explaining an operation of the catch tray during sheet discharge.
Figure 15B:
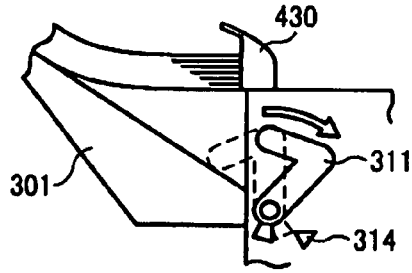
Figure 15C:
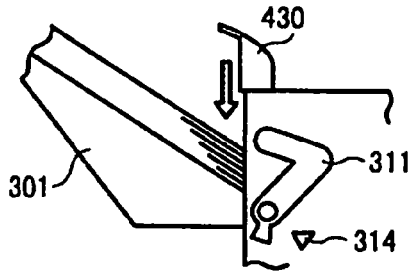
Figure 15D:
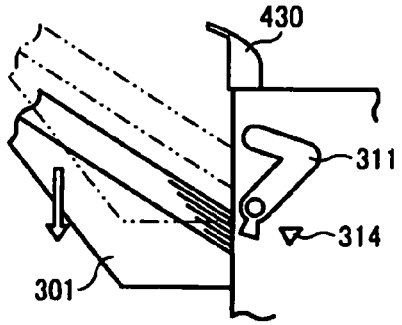
Figure 15E:
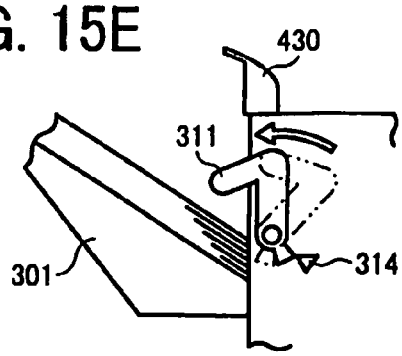
Figure 15F:
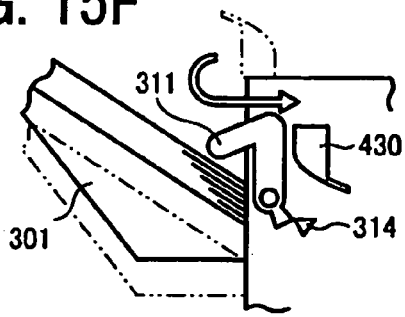
Figure 15G:
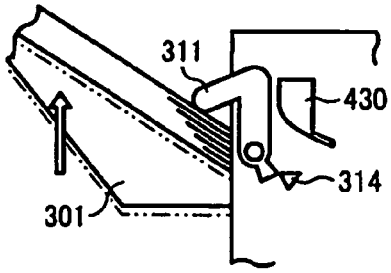
Figure 15H:
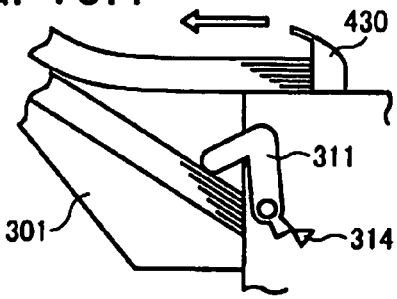
Figure 16A:
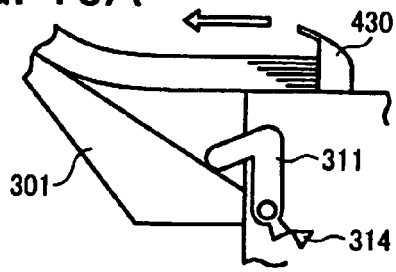
FIGS. 16A to 16H are schematic diagrams for explaining the operation of the catch tray during sheet discharge.
Figure 16B:
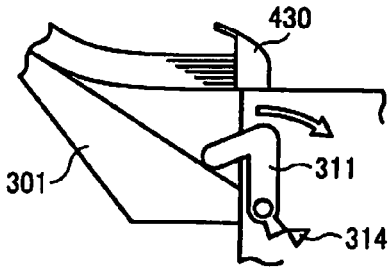
Figure 16C:
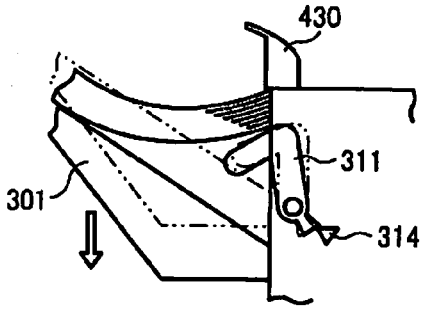
Figure 16D:
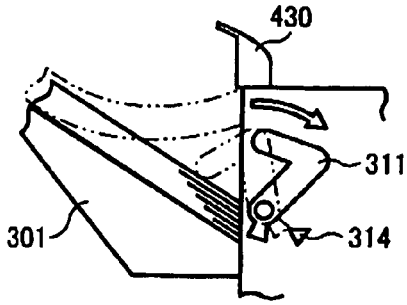
Figure 16E:
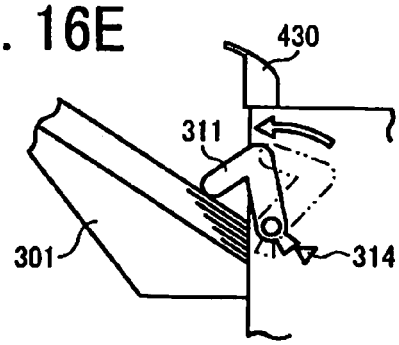
Figure 16F:
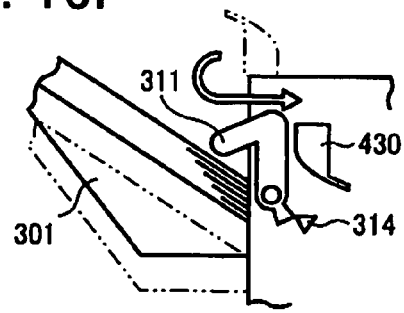
Figure 16G:
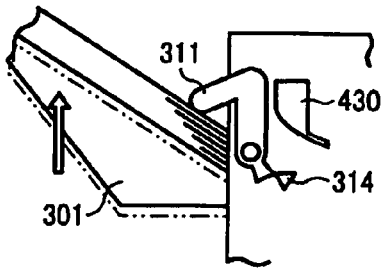
Figure 16H:
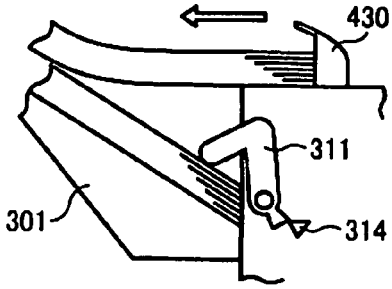

FIG. 12 is a timing chart of drive timings of a sheet-conveyance stepping motor, the sheet inlet sensor, the tapping roller SOL, the tapping-roller stepping motor, and a pre-jogger driving motor and a post-jogger driving motor. The functioning of all the parts involved in sheet conveyance right up to sheet alignment and sheet discharge is explained with reference to the timing chart.

If the size of the sheet discharged from the image forming apparatus is small in the sheet conveyance direction (B5Y/A4Y), the sheet approaches the sheet inlet 205, and the sheet inlet sensor 206 detects the leading edge of the sheet. A sheet-conveyance stepping motor 211 accelerates after the leading edge of the sheet is conveyed to a distance of 20 millimeters following the detection by the sheet inlet sensor 206, and conveys the sheet at a velocity of 500 mm/s, increased from a receiving linear velocity of 138 mm/s. If the size of the sheet in the sheet conveyance direction is not B5Y or A4Y, the sheet is conveyed at an accelerated speed after the sheet is carried to a given distance after the rear edge of the sheet goes past a discharge sensor (not shown) of the image forming apparatus.

In the conveying path 204, after the sheet is conveyed at an accelerated speed up to a given distance after the rear edge of the sheet goes past the sheet inlet sensor 206, when the rear edge of the sheet reaches the point which is 30 millimeters on the upstream side of the discharge rollers 208, the sheet-conveyance stepping motor 211 decelerates, slowing down the conveying speed to 200 m/s if the sheet size is small and to 300 m/s if the sheet size is large. The linear velocity of the discharge rollers 208 discharges the sheet into the stapling tray 401.

When the rear edge of the sheet has traversed 5 millimeters past the discharge rollers 208, the lever 221 starts turning by the drive force of the DC/SOL 223 or the stepping motor 224, the swinging arm 213 turns towards the stapling tray 401, the tapping roller 214 touches the rear edge of the sheet discharged into the stapling tray 401, and the rotation of the tapping roller 214 causes the rear edge of the sheet to touch the reference fences 410 and 411. The position of the sheet is upheld when the sheet with its rear edge touching the reference fences 410 and 411 is further pushed against the reference fences 410 and 411 by the rotating returning roller 230.

FIGS. 13A to 13I are schematic diagrams for explaining a sheet aligning operation of the jogger fences 402 and 403 in a sift mode.

At the same time as the reception of a sheet discharge signal from the image forming apparatus, the jogger fences 402 and 403 move to sheet receiving positions according to the width of the sheet being conveyed (see FIG. 13A). Each of the jogger fences 402 and 403 moves to a position that is 15 millimeters away from either edge of the sheet in the sift mode, and to a position that is 7 millimeters away from either edge of the sheet in a stapling mode, and halts at the position.

In the sift mode, after the rear edge of the sheet goes past the discharge rollers 208 (see FIG. 13B), and comes to touch the reference fences 410 and 411 due to the rotating tapping roller 214 and the returning roller 230 (see FIG. 13C), the jogger fence 402 on the approaching side shifts towards the jogger fence 403 on the reference side, and aligns the side edge of the sheet against the jogger fence 403. Following this, the jogger fence 402 once again moves back by 30 millimeters, halts at the sheet receiving position, and stands by to accept the next sheet. These steps are repeated until the entire sheet bunch is aligned against the jogger fence 403 on the reference side (see FIG. 13D). After a designated number of sheets are aligned and the discharge pawl 430 discharges the sheet bunch into the catch tray 301 (see FIG. 13E), the roles of the jogger fences 402 and 403 are switched for the sheets belonging to the next sheet bunch, the jogger fence 403 becoming the approaching side member and the jogger fence 402 becoming the reference side member. Thus, the approaching direction of the sheets of the new sheet bunch is opposite to that of the previous sheet bunch (see FIGS. 13F to 13I). Thus, the sheet bunches are stacked up in a staggered form in the catch tray 301 after several repetitions of the above steps. The action timings of the jogger fences 402 and 403 are controlled by managing time based on the sheet inlet sensor's 206 detection of the rear edge of the sheet getting past.

FIGS. 14A to 14E are schematic diagrams for explaining a sheet discharge operation by the movable fence 445 and the discharge pawls 430 and 431.

After the last sheet is aligned by the jogger fences 402 and 403 prior to discharge, and before the returning roller 230 complete their aligning operation against the reference fences 410 and 411, the movable fence 445 and the discharge pawls 430 and 431 start to be driven to move towards the catch tray 301 (see FIG. 14A). Before the last sheet comes into contact with the reference fences 410 and 411, the movable fence 445 comes into contact with the rear edge of the sheet, aligns the sheet with the rest of the aligned sheets, and sends the sheet bunch towards the catch tray 301 (see FIG. 14B). With the movable fence 445, the discharge pawls 430 and 431 are also driven, and receive the sheet bunch at the time the discharge pawls 430 and 431 get ahead of the movable fence 445, and continue to send it along towards the catch tray 301 (see FIG. 14C). In the meantime, the movable fence 445 returns to the standby position. Following this, the discharge pawls 430 and 431 come to a halt, and when the discharge pawls 430 and 431 are halted, the sheet bunch drops into the catch tray 301 (see FIG. 14D). After the sheet bunch drops into the catch tray 301, the discharge pawls 430 and 431 return to their standby positions (see FIG. 14E).

After a designated number of sheets are aligned and the sheet bunch is discharged into the catch tray 301, the roles of the jogger fences 402 and 403 are switched for the sheets belonging to the next sheet bunch. Thus, the sheet bunches are stacked up in a staggered form in the catch tray 301 after several repetitions of the above steps. The action timings of the jogger fences 402 and 403, the discharge pawls 430 and 431, and the movable fence 445 are controlled by managing time based on the sheet inlet sensor's 206 detection of the rear edge of the sheet getting past.

FIGS. 15A to 15H and FIGS. 16A to 16H are schematic diagrams for explaining the operation of the catch tray 301 during sheet discharge.

The position at which the catch tray 301 pushes against the fore-ends 311*a* of the sheet holding members 311 and is detected by the sheet-height detecting sensor 314 or the position to which the catch tray 301 ascends by a designated distance after being detected by the sheet-height detecting sensor 314 is the standby position of the catch tray 301 during discharge of sheets to the aligning unit by the discharge rollers 208. The aligning and stapling operations are carried out at the standby position.

After the sheet bunch is aligned by the jogger fences 402 and 403, and subjected to sifting and stapling processes, the discharge pawl 430 advances and discharges the sheet bunch into the catch tray 301 (see FIGS. 15A to 15C and FIGS. 16A to 16C). At the same time as the discharge pawl 430 halts after advancing, the suction action of the DC/SOL 315 starts driving the sheet holding members 311 to turn so as to be more completely retracted than the end fence 310 (see FIGS. 15A and 15B). Just as the discharge pawl 430 halts, the DC motor 309 starts driving the catch tray 301 to descend by a designated distance, and lets the sheet bunch drop into the catch tray 301 (see FIGS. 15C and 15D). Just as the catch tray 301 comes to a halt, the DC/SOL 315 switches off and causes the sheet holding members 311 to again jut out in relation to the end fence 310 (see FIG. 15E). Immediately following this, the catch tray 301 ascends again, causing the top of the sheet bunch to come up against the sheet holding members 311, and halts at the position where the sheet-height detecting sensor 314 detects the catch tray 301 or after ascending by a designated distance from the position where the sheet-height detecting sensor 314 detects the catch tray 301 (see FIGS. 15F and 15G). The fore-ends 311*a* of the sheet holding members 311 press down near the rear edge of the sheet, ready to receive the next sheet bunch (see FIG. 15H).

Alternatively, at the same time as the discharge pawl 430 halts after advancing, the DC motor 309 starts driving the catch tray 301 to descend by a designated distance (see FIG. 16C), and lets the sheet bunch to drop into the catch tray 301. Just as the catch tray 301 comes to a halt, the suction action of the DC/SOL 315 starts driving the sheet holding members 311 to turn so as to be more completely retracted than the end fence 310 (see FIG. 16D). Immediately following this, the DC/SOL 315 switches off, and causes the sheet holding members 311 to again jut out in relation to the end fence 310 (see FIGS. 16E and 16F). Immediately following this, the catch tray 301 ascends again, causing the top of the sheet bunch to come up against the sheet holding members 311, and halts at the position where the sheet-height detecting sensor 314 detects the catch tray 301 or after ascending by a designated distance from the position where the sheet-height detecting sensor 314 detects the catch tray 301 (see FIG. 16G). The fore-ends 311*a* of the sheet holding members 311 press down near the rear edge of the sheet, ready to receive the next sheet bunch (see FIG. 16H).

The sheet bunches are stacked up in the catch tray 301 in this manner.

Figure 17:
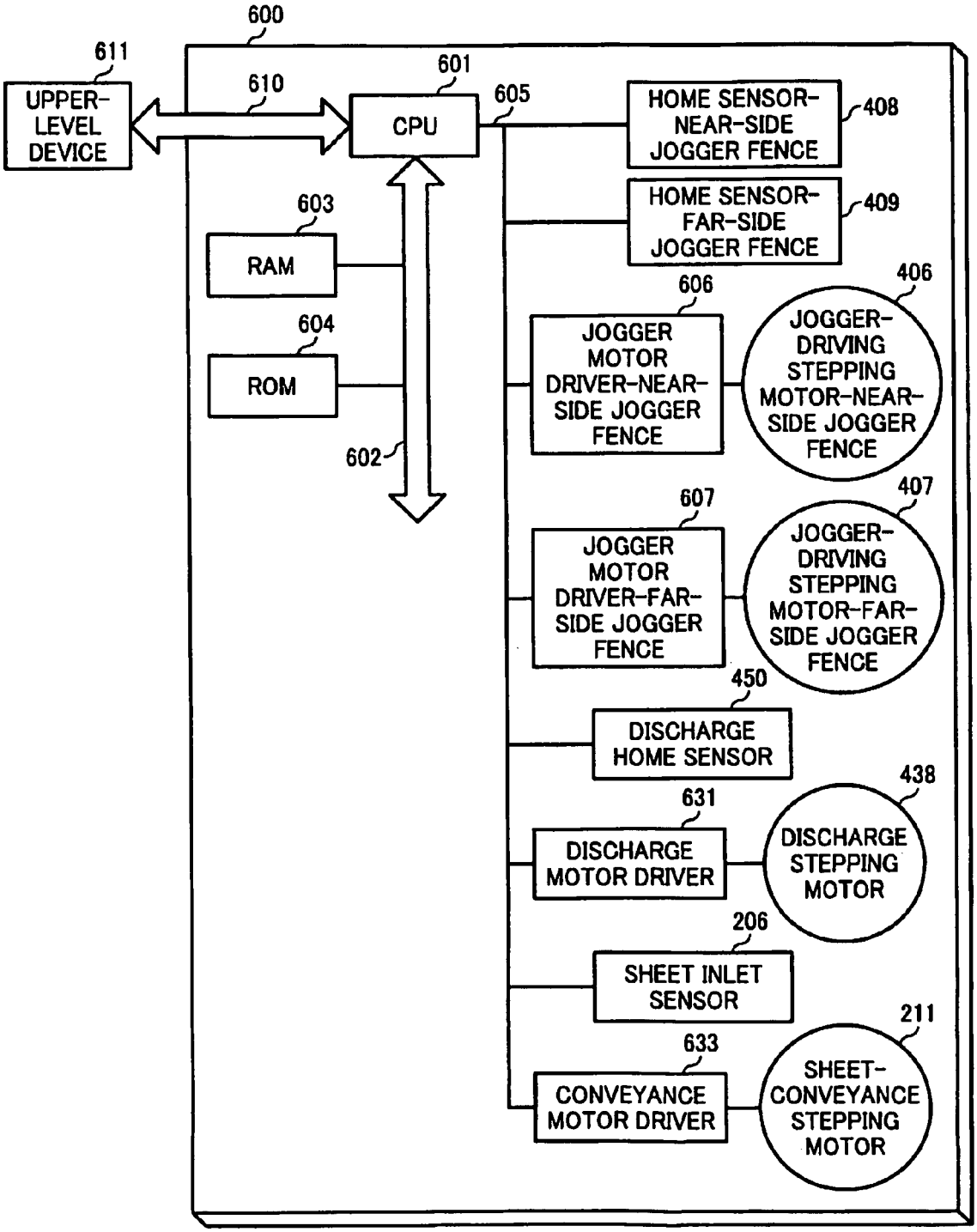
FIG. 17 is a block diagram of a control mechanism of the sheet processing device and the image forming apparatus according to the embodiment.

FIG. 17 is a block diagram of a control system of the sheet processing device equipped with the sheet aligning device according to the embodiment, in particular showing the control system concerning sheet alignment and discharge.

A control unit 600 of the sheet post-processing device includes a central processing unit (CPU) 601, a random access memory (RAM) 603, and a read-only memory (ROM) 604, and a bus 602 connecting the RAM 603 and the ROM 604 to the CPU 601. The CPU 601 reads and executes a control program from the ROM 604. The RAM 603 temporarily stores therein data necessary for the control process. The CPU 601 is connected via an input-output (I/O) port 605 to the home sensor 408 of the near-side jogger fence for controlling the jogger fence 402, as well as to a jogger motor driver 606 of the near-side jogger fence. The CPU 601 determines the position of the jogger fence 402 from an input from the home sensor 408, and causes the jogger fence 402 to move by driving the jogger-driving stepping motor 406.*to* rotate by outputting signals to the jogger motor driver 606 based on the input from the home sensor 408. Similarly, the CPU 601 is also connected to the home sensor 409 of the far-side jogger fence for controlling the jogger fence 403, as well as to a jogger motor driver 607, and moves the jogger fence 403 by driving the jogger-driving stepping motor 407.

The CPU 601 is connected to the sheet-conveyance stepping motor 211 through a conveyance motor driver 633. The CPU 601 drives the sheet-conveyance stepping motor 211 to transport the received sheet, and by driving the tapping roller 214 and the returning roller 230 coupled to the sheet-conveyance stepping motor 211, causes the sheet in the stapling tray 401 to come into contact with the reference fences 410 and 411. The CPU 601 determines the relative distance between the sheet and the sheet inlet sensor 206 based on the status of the sheet inlet sensor 206 and a pulse count output to the conveyance motor driver 633 for driving the sheet-conveyance stepping motor 211.

The CPU 601 is also connected to the discharge home sensor 450 that controls the movable fence 445 and the discharge pawls 430 and 431, as well as a discharge motor driver 631. The CPU 601 drives the discharge stepping motor 438 to move the movable fence 445, and the discharge pawls 430 and 431 and to discharge the sheet bunch into the catch tray 301.

The CPU 601 is connected to an upper-level device 611, which is the image forming apparatus, via a serial bus 610.

Figure 18:
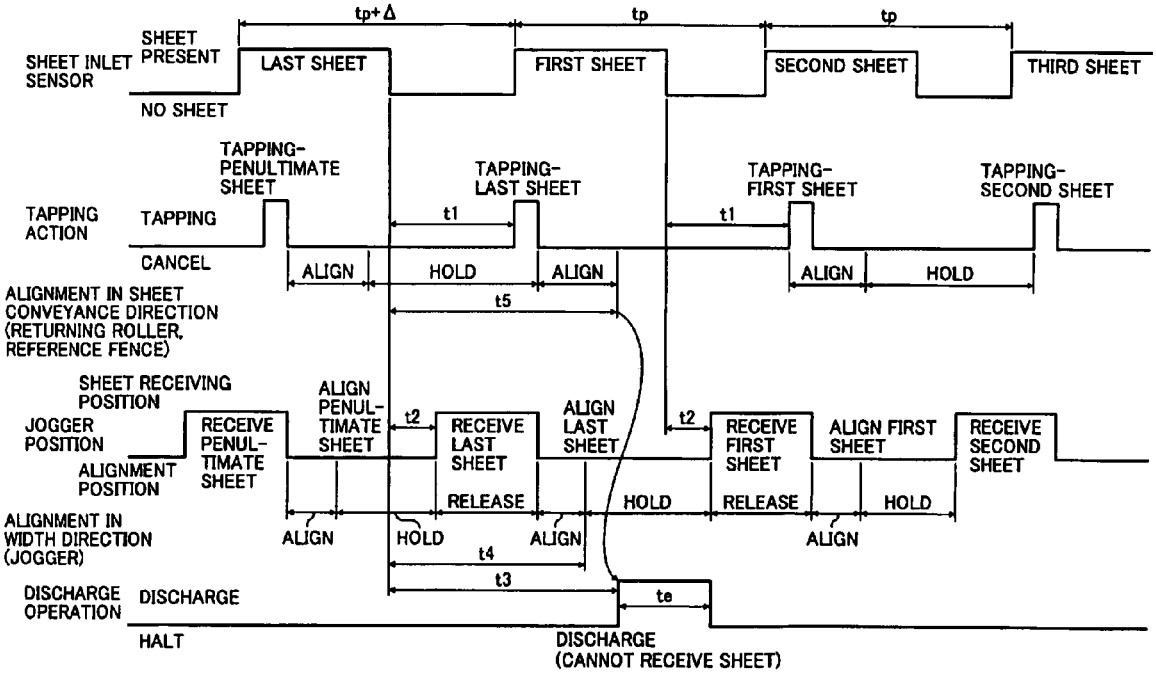
FIG. 18 is a timing chart of an operation timing of each part when a predetermined condition is not satisfied.
Figure 19:
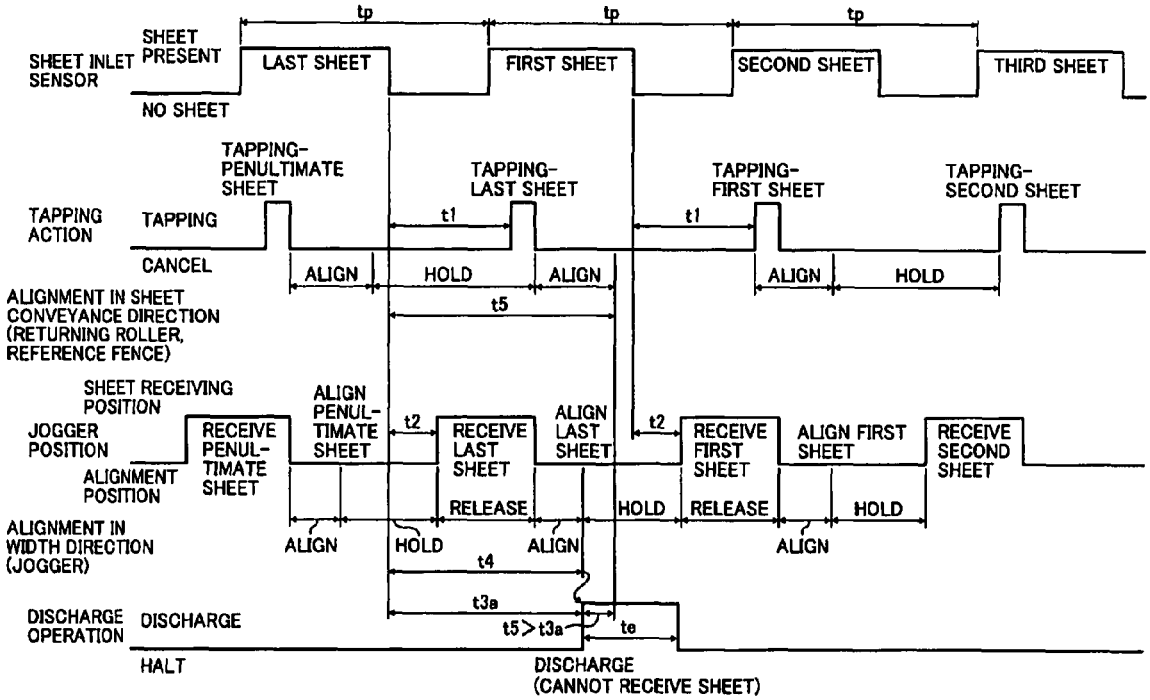
FIG. 19 is a timing chart of an operation timing of each part when a predetermined condition is satisfied.

FIGS. 18 and 19 are timing charts of operation timing of each part. The timing chart in FIG. 18 represents conventional operation timing when a predetermined condition is not satisfied (concerns a second aligning unit). The timing chart in FIG. 19 represents the operation timing when the predetermined condition is satisfied (concerns a first aligning unit).

In FIG. 18, after a lapse of a designated time period t2 after the rear edge of the last sheet leaves the sheet inlet sensor 206, the jogger fences 402 and 403 move to the sheet receiving positions. At this time, the control of the stacked up sheets in the stapling tray 401 in width direction is lifted. After a further lapse of a designated time period, the jogger fences 402 and 403 move to the alignment positions, and the sheets are aligned in the width direction and sifted. The time period required for completing alignment is t4.

The tapping roller 214 starts descent, comes into contact with the last sheet and moves the last sheet towards the reference fences 410 and 411, and the returning roller 230 and the reference fences 410 and 411 align the sheets in the sheet conveyance direction after a lapse of a designated time period t1 after the rear edge of the last sheet leaves the sheet inlet sensor 206. The time period required for completing alignment is t5. A weak returning force is set for the returning roller 230 so as not to damage the sheet surface. Therefore, alignment in the sheet conveyance direction takes longer than alignment in the width direction and sifted. Therefore, t5>t4. In other words, as can be understood from FIG. 19, the time period t5 required to complete alignment in the sheet conveyance direction by the returning roller 230 and the reference fences 410 and 411 is longer than the time period t4 required to complete aligning in the width direction by the jogger fences 402 and 403.

The discharge is performed after a lapse of a designated time period t1 after the rear edge of the last sheet leaves the sheet inlet sensor 206. A designated time period te is required for the ejection operation. When the discharge operation is underway, the stapling tray 401 cannot receive any sheet as the movable fence 445 and the discharge pawls 430 and 431 traverse over the stapling tray 401. Therefore, the condition represented by the relational expression t3+te≧tp−t2 has to be satisfied, and to achieve this, it is necessary to increase the time interval between the sheets during discharge by A. In the relational expression, tp represents the time interval between the sheets.

The operation timings in the timing chart shown in FIG. 19 are different from those shown in FIG. 18. In the case shown in FIG. 19, the discharge operation commences before a designated time period t5 elapses (t5>t3*a*), so that the relational expression t3*a*+te≧tp−t2 is satisfied. Hence, the need for increasing the time interval between the sheets during discharge operation is eliminated. Consequently, drop in productivity can be eliminated.

However, in this case, the time period in which alignment is completed in the sheet conveyance direction is shortened. Hence, the alignment may be compromised. Therefore, it is preferable to use sheet properties as criteria for determining whether the processes should be carried out according to the timings shown in FIG. 19. In the embodiment, the judgment that the discharge operation should commence before the completion of sheet alignment is taken only if the following four conditions are satisfied.

(1) There is a single sheet in the stapling tray 401

(2) The sheet is of A4 size or letter size (3) The sheet is of normal thickness and is neither very thin nor very thick (4) The sheet has not been subjected to folding processing The embodiment requires that all of the four conditions be satisfied. However, the conditions can be relaxed, modified, or new conditions added depending on the device properties or required level of quality. In the embodiment, the relational expression t4<t3*e* is employed. However, the relational expression t4>t3*e* can also be employed, as long as the quality of sheet alignment is not compromised.

Figure 20:
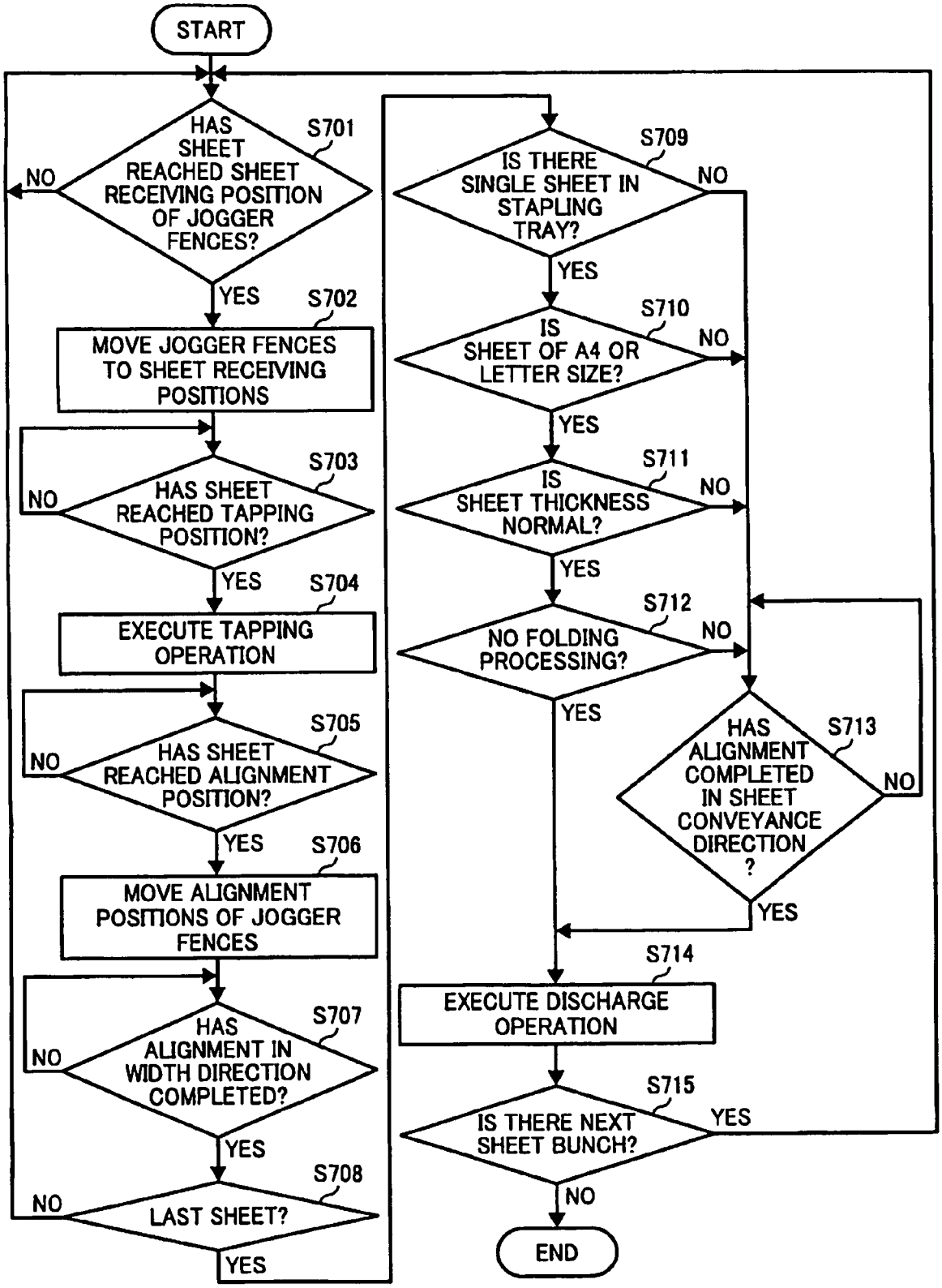
FIG. 20 is a flowchart of a control procedure performed by the sheet aligning device according to the embodiment.

FIG. 20 is a flowchart of the control procedure performed by the sheet aligning device according to the embodiment.

In the control procedure, the process starts when the sheet-conveyance stepping motor 211 commences driving (Step S700). The sheet is conveyed along the conveying path 204, and the jogger fences 402 and 403 stand by until the sheet reaches the sheet receiving position in the conveying path 204 (Step S701). When the sheet reaches the designated position, the jogger fences 402 and 403 move to the sheet receiving positions (Step S702). When the sheet reaches a tapping position (Yes at Step S703), the tapping roller 214 is lowered so that tapping action can take place (Step S704). After a lapse of a designated time period, the tapping roller 214 ascends to the standby position allowing the sheet to reach the alignment position (Step S705). When the sheet reaches the alignment position, the jogger fences 402 and 403 move to the alignment positions and align the sheet in the width direction. Alignment of the sheet in the sheet conveyance direction is performed by the returning roller 230 and the reference fences 410 and 411 in conjunction with alignment of the sheet in the width direction by the jogger fences 402 and 403 (Step S706).

Upon completion of alignment in the width direction (Yes at Step S707), it is determined whether the sheet just aligned is the last sheet (Step S708). If it is not the last sheet, the system control returns to Step S701. If it is the last sheet, it is determined whether there is a single sheet in the stapling tray 401 (Step S709). If there is a single sheet in the stapling tray 401, it is determined whether the sheet is of A4 size or letter size (Step S710). If the sheet size is of A4 size or letter size, it is determined whether the sheet thickness is normal (Step S711). If the sheet is of normal thickness, it is determined whether the sheet has been subjected to folding processing (Step S712). If all the conditions are satisfied, the discharge operation of the sheet is performed (Step S714). If any of the conditions is not satisfied, the alignment in the sheet conveyance direction is completed (Step S713) followed by the discharge operation of the sheet (Step S714). It is determined whether there is a next sheet bunch (Step S715). If there is a next sheet bunch, the system control returns to Step S701 and receives the next sheet. If there is no next sheet bunch, the sheet-conveyance stepping motor 211 halts, ending the process (Step S716).

The following effects are realized due to the embodiment.

1. The discharge pawls 430 and 431 commence the discharge operation before the returning roller 230 completes the alignment operation. Consequently, the need for increasing the gap between sheets is eliminated even in the case where the discharge operation is likely to take long.
2. Under the conditions when the quality of sheet alignment is likely to be compromised if the discharge pawls 430 and 431 commence the discharge operation before the returning roller 230 completes the alignment operation, the discharge operation commences after completion of the alignment operation by the returning roller 230. Consequently, compromise in the quality of sheet alignment is eliminated.
3. If the number of stacked sheets is such that the quality of sheet alignment is likely to be compromised if the discharge pawls 430 and 431 commence the discharge operation before the returning roller 230 completes the alignment operation, the discharge operation commences after completion of the alignment operation by the returning roller 230. Consequently, compromise in the quality of sheet alignment is eliminated.
4. If the size of the sheet is such that the quality of sheet alignment is likely to be compromised if the discharge pawls 430 and 431 commence the discharge operation before the returning roller 230 completes the alignment operation, the discharge operation by the discharge pawls 430 and 431 commences after completion of the alignment operation by the returning roller 230. Consequently, compromise in the quality of sheet alignment is eliminated.
5. If the sheet has been subjected to folding processing that the quality of sheet alignment is likely to be compromised if the discharge pawls 430 and 431 commence the discharge operation before the returning roller 230 completes the alignment operation, the discharge operation by the discharge pawls 430 and 431 commences after completion of the alignment operation by the returning roller 230.
6. If there is a plurality of sheets in the stack, the discharge operation commences after the returning roller 230 completes the alignment operation. Consequently, a drop in productivity that occurs when there is only one sheet in a lot can be eliminated without compromising the quality of sheet alignment.
7. Enhanced quality of sheet alignment is achieved and a sifting process of the sheets can be performed because of the jogger fences 402 and 403 that align the sheets in a direction orthogonal to the sheet conveyance direction.
8. The discharge operation commences after completion of alignment of the sheet in a direction orthogonal to the sheet conveyance direction. Consequently, a drop in productivity is eliminated while keeping up the quality of sheet alignment.

According to an aspect of the present invention, when a predetermined condition is satisfied, a sheet discharge timing of a sheet discharging unit is shortened compared to normal sheet discharge timing. Consequently, with a simple configuration, irrespective of the number of sheets in a sheet bunch and other such conditions, a drop in productivity can be prevented while maintaining sheet alignment quality.

The above and other objects, features, advantages and technical and industrial significance of this invention will be better understood by reading the following detailed description of presently preferred embodiments of the invention, when considered in connection with the accompanying drawings.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A sheet aligning device comprising:

a conveying unit that receives at least one sheet from an upstream unit and conveys the at least one sheet on a conveying path;

a stacking unit that stacks the at least one sheet conveyed from the conveying unit;

a first aligning unit that sets the at least one sheet back in a direction opposite to a sheet conveying direction and aligns the at least one sheet by bumping the at least one sheet against a reference wall;

a sheet discharging unit that discharges the at least one sheet from the stacking unit in the sheet conveying direction; and a control unit that, when a predetermined condition is satisfied, sets a timing for the discharging unit to discharge the at least one sheet as the first aligning unit is setting the at least one sheet back in the direction opposite to the sheet conveying direction but prior to the first aligning unit successfully completing the bumping of the at least one sheet against the reference wall.

2. The sheet aligning device according to claim 1, wherein the predetermined condition is a property of the at least one sheet stacked on the stacking unit.

3. The sheet aligning device according to claim 2, wherein the property of the at least one sheet is an actual number of sheets stacked on the stacking unit.

4. The sheet aligning device according to claim 2, wherein the property of the at least one sheet is a thickness of the at least one sheet stacked on the stacking unit.

5. The sheet aligning device according to claim 2, wherein the property of the at least one sheet is a folded status of the at least one sheet stacked on the stacking unit.

6. The sheet aligning device according to claim 3, wherein the number of sheets is one.

7. The sheet aligning device according to claim 2, wherein the property of the at least one sheet is a size of the at least one sheet stacked on the stacking unit.

8. The sheet aligning device according to claim 1, further comprising a second aligning unit that aligns the at least one sheet in a direction substantially perpendicular to the sheet conveying direction.

9. The sheet aligning device according to claim 8, wherein the second aligning unit sorts the at least one sheet stacked on the stacking unit by shifting an aligning position of the at least one sheet in the direction substantially perpendicular to the sheet conveying direction.

10. The sheet aligning device according to claim 8, wherein the control unit sets the timing for discharging the at least one sheet by the sheet discharging unit to occur directly following the second aligning unit finishing either one of an aligning operation and a sorting operation.

11. A sheeting processing device comprising:

a sheet aligning device that includes a conveying unit that receives at least one sheet from an upstream unit and conveys the at least one sheet on a conveying path, a stacking unit that stacks the at least one sheet conveyed from the conveying unit, a first aligning unit that sets the at least one sheet back in a direction opposite to a sheet conveying direction and aligns the sheet by bumping the at least one sheet against a reference wall, a sheet discharging unit that discharges the at least one sheet from the stacking unit in the sheet conveying direction, and a control unit that, when a predetermined condition is satisfied, sets a timing for the discharging unit to discharge the at least one sheet as the first aligning unit is setting the at least one sheet back in the direction opposite to the sheet conveying direction but prior to the first aligning unit successfully completing the bumping of the at least one sheet against the reference wall.

12. The sheet processing device of claim 11, wherein the predetermined condition is a property of the at least one sheet stacked on the stacking unit, the property being one or more of a sheet size, a sheet thickness, a sheet folded status and an actual number of sheets.

13. The sheet processing device of claim 11, further comprising:

a second aligning unit that aligns the at least one sheet in a direction substantially perpendicular to the sheet conveying direction, wherein the second aligning unit sorts the at least one sheet stacked on the stacking unit by shifting an aligning position of the at least one sheet in the direction substantially perpendicular to the sheet conveying direction, wherein the control unit sets the timing for discharging the at least one sheet by the sheet discharging unit to occur directly following the second aligning unit finishing either one of an aligning operation and a sorting operation.

14. An image forming apparatus comprising:

a sheeting processing device that includes a sheet aligning unit, the sheet aligning unit including a conveying unit that receives at least one sheet from an upstream unit and conveys the at least one sheet on a conveying path, a stacking unit that stacks the at least one sheet conveyed from the conveying unit, a first aligning unit that sets the at least one sheet back in a direction opposite to a sheet conveying direction and aligns the at least one sheet by bumping the at least one sheet against a reference wall, a sheet discharging unit that discharges the at least one sheet from the stacking unit in the sheet conveying direction, and a control unit that, when a predetermined condition is satisfied, sets a timing for the discharging unit to discharge the at least one sheet as the first aligning unit is setting the at least one sheet back in the direction opposite to the sheet conveying direction but prior to the first aligning unit successfully completing the bumping of the at least one sheet against the reference wall.

15. The sheet aligning device according to claim 2, wherein the predetermined condition is that there is only one sheet stacked on the stacking unit, the single sheet is at least one of A4 size or letter size, the single sheet is a normal thickness and the single sheet has not been subjected to a folding process.

16. The image forming apparatus of claim 14, wherein the predetermined condition is a property of the at least one sheet stacked on the stacking unit, the property being one or more of a sheet size, a sheet thickness, a sheet folded status and an actual number of sheets.

17. The image forming apparatus of claim 14, further comprising:

a second aligning unit that aligns the at least one sheet in a direction substantially perpendicular to the sheet conveying direction, wherein the second aligning unit sorts the at least one sheet stacked on the stacking unit by shifting an aligning position of the at least one sheet in the direction substantially perpendicular to the sheet conveying direction, wherein the control unit sets the timing for discharging the at least one sheet by the sheet discharging unit to occur directly following the second aligning unit finishing either one of an aligning operation and a sorting operation.

* * * * *